US008800206B2

(12) United States Patent
Vaknin et al.

(10) Patent No.: US 8,800,206 B2
(45) Date of Patent: Aug. 12, 2014

(54) MOTORIZED CLOSURE ASSEMBLY

(75) Inventors: Oren Vaknin, Netanya (IL); Yoav Rodan, D.N. Bikat Beit Hakerem (IL); Moti Levi, D.N. Marom Galil (IL); Giora Silne, Karmiel (IL)

(73) Assignee: New Visions Yezirot Aluminum, Ltd., Even Yehuda (IL)

( * ) Notice: Subject to any disclaimer, the term of this patent is extended or adjusted under 35 U.S.C. 154(b) by 0 days.

(21) Appl. No.: 13/589,873

(22) Filed: Aug. 20, 2012

(65) Prior Publication Data

US 2014/0047770 A1 Feb. 20, 2014

(51) Int. Cl.
*E05F 11/00* (2006.01)

(52) U.S. Cl.
USPC ..... 49/358

(58) Field of Classification Search
USPC ..... 49/358, 360, 404
See application file for complete search history.

(56) References Cited

U.S. PATENT DOCUMENTS

| | | | | |
|---|---|---|---|---|
| 3,331,428 | A * | 7/1967 | Ford | 160/331 |
| 4,672,773 | A * | 6/1987 | Bilt | 49/358 |
| 4,754,572 | A * | 7/1988 | Bilt | 49/358 |
| 5,546,706 | A * | 8/1996 | Coupet | 49/420 |
| 6,298,520 | B1 * | 10/2001 | Blickhahn et al. | 16/71 |
| 6,581,332 | B1 * | 6/2003 | Kim | 49/358 |
| 8,381,445 | B2 * | 2/2013 | Hans | 49/316 |
| 8,474,185 | B2 * | 7/2013 | Busch | 49/358 |
| 2007/0271850 | A1 * | 11/2007 | Mickelson | 49/358 |
| 2012/0110911 | A1 * | 5/2012 | Heng et al. | 49/358 |
| 2012/0192490 | A1 * | 8/2012 | McCaslin | 49/31 |
| 2012/0272576 | A1 * | 11/2012 | Van Tassell et al. | 49/70 |

* cited by examiner

*Primary Examiner* — Jerry Redman
(74) *Attorney, Agent, or Firm* — Blue Filament Law PLLC; Avery N. Goldstein; Guy Levi

(57) ABSTRACT

The disclosure is directed to motorized closure assembly, comprising: an opening frame configured to fit around the opening; a substantially rectangular closure slab having a closure slab frame configured to surround the substantially rectangular closure slab and sealingly fit within the opening frame; and a motorized driver, wherein the motorized driver is entirely embedded within the closure slab frame or within a combination of the closure slab frame and the opening frame, the motorized driver configured to slidably move the slab between an open position and a closed position.

13 Claims, 23 Drawing Sheets

FIG. 2A
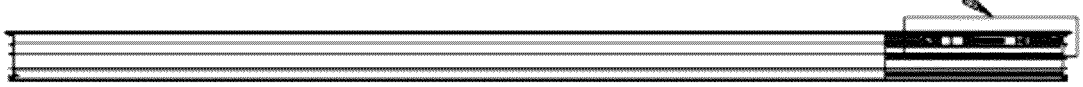
FIG. 15A
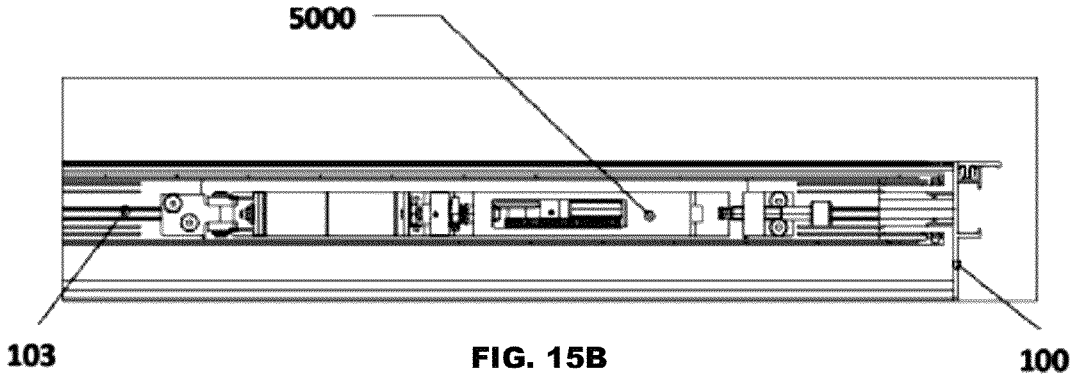
FIG. 15B

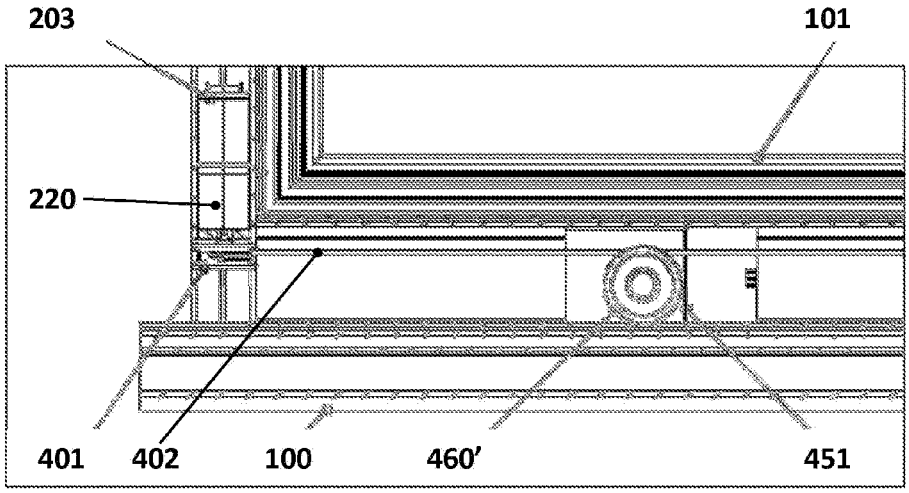
FIG. 20B
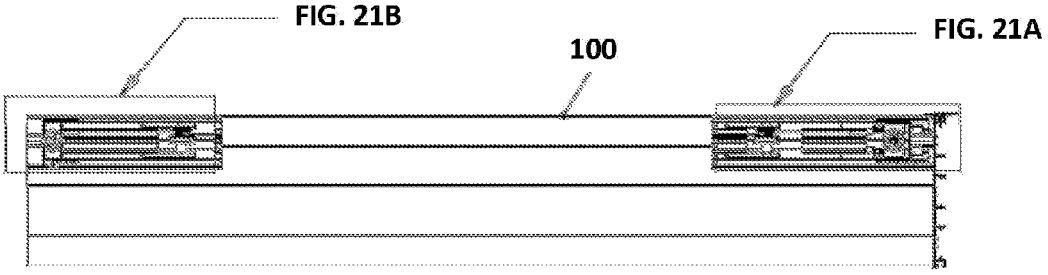
FIG. 21
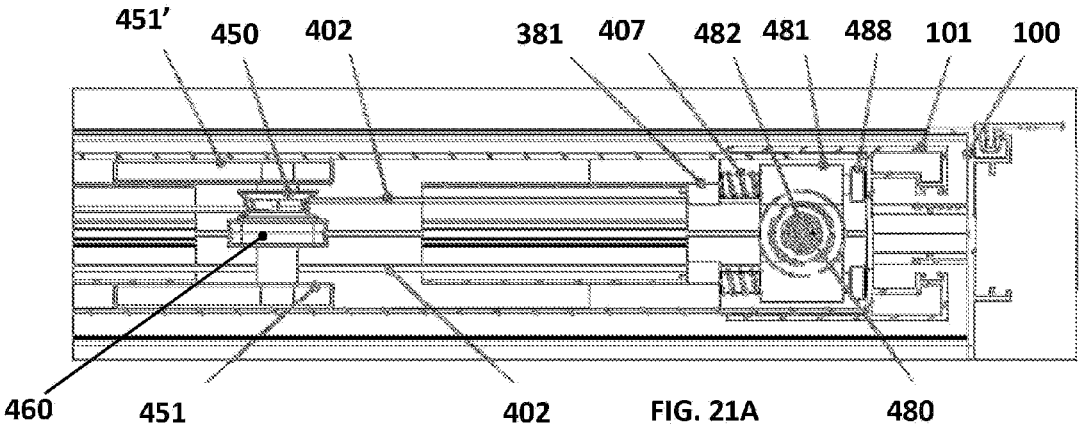

MOTORIZED CLOSURE ASSEMBLY

BACKGROUND

The disclosure is directed to motorized closure assembly. Specifically, the disclosure is directed to motorized sliding windows and doors.

Building doors and windows include a number of different types of designs such as overhead doors and windows, horizontal sliding doors and windows, vertical lift doors and windows, folding doors and windows, pocket doors and windows, roller doors and windows etc. With space for buildings and apartments getting increasingly small, so does the space available for any driving mechanisms configured to open and close these doors and windows.

Additionally, safety and aesthetic considerations impose design restrictions making commonly used externally visible and accessible drive mechanisms undesirable.

Accordingly, there is a need for concealed drive mechanisms for doors.

SUMMARY

In an embodiment, provided is a motorized closure assembly, comprising: an opening frame configured to fit around the opening; a substantially rectangular closure slab having a closure slab frame configured to surround the substantially rectangular closure slab and sealingly fit within the opening frame; a driver, the driver concealed in a recess behind the opening frame and coupled to a driver pulley; a frame pulley, concealed in a recess behind the opening frame on a side opposite the driver; and a cable having a proximal end and a distal end, disposed between the frame pulley the driver pulley, and operably coupled to the slab frame wherein the driver, the cable, the motor pulley and the frame pulley are concealed regardless of the position of the closure slab in relation to the opening frame, the assembly capable of slidably moving the slab between an open position and a closed position.

In another embodiment, provided herein is a drivetrain for a motorized closure assembly, comprising: a leveling assembly; and a mobilizing assembly, wherein the mobilizing assembly comprises: a driver; a clutch; a gear box; and a track wheel coupled to the gear box, the track wheel configured to engage a rail.

In an embodiment, provided herein is a motorized closure assembly, comprising: an opening frame configured to fit around at least the top horizontal side, a distal vertical side, and a bottom horizontal side of a substantially rectangular opening; a substantially rectangular closure slab having a closure slab frame configured to surround the substantially rectangular closure slab and sealingly fit within the opening frame; a driver, the driver embedded within a proximal vertical side of the substantially rectangular closure slab and coupled to a driver pulley; a frame pulley, embedded within and coupled to a distal horizontal side of the substantially rectangular closure slab on a horizontal side opposite the driver pulley; a first free pulley disposed between the driver pulley and the frame pulley and operably coupled to the closure slab frame; and a cable connecting the motor pulley, the first free pulley and the frame pulley, wherein the cable and the free pulley are embedded within the closure slab frame.

In yet another embodiment, provided herein is a motorized closure assembly, comprising: an opening frame configured to fit around the opening; a substantially rectangular closure slab having a closure slab frame configured to surround the substantially rectangular closure slab and sealingly fit within the opening frame; and a motorized driver, wherein the motorized driver is entirely embedded within the closure slab frame or within a combination of the closure slab frame and the opening frame, the motorized driver configured to slidably move the slab between an open position and a closed position.

BRIEF DESCRIPTION OF THE DRAWINGS

The features of the motorized opening closure described will become apparent from the following detailed description when read in conjunction with the drawings, which are exemplary, not limiting, and wherein like elements are numbered alike in several figures and in which:

FIG. 2A shows the frame pulley assembly and FIG. 2B shows the coupling of the frame pulley and the closure slab frame;

FIG. 14 shows an illustration of an opening comprising three motorized panes according to another embodiment of the technology where

FIGS. 15A and 15B show a cut-away illustration of the first drivetrain in relation to the closure slab frame (FIG. 15A), magnified in FIG. 15B, according to an embodiment of the technology;

FIGS. 20A, 20B, and 21 show a side view (FIG. 20A) and a bottom view (FIG. 21) of an illustration of frame and free pulley disposed at the bottom of the closure frame (FIG. 20A, 21A) and driver, driver pulley and an additional free pulley disposed at the bottom of the closure frame (FIG. 20B, 21B) according to an embodiment of the technology;

DETAILED DESCRIPTION

Figure 1:
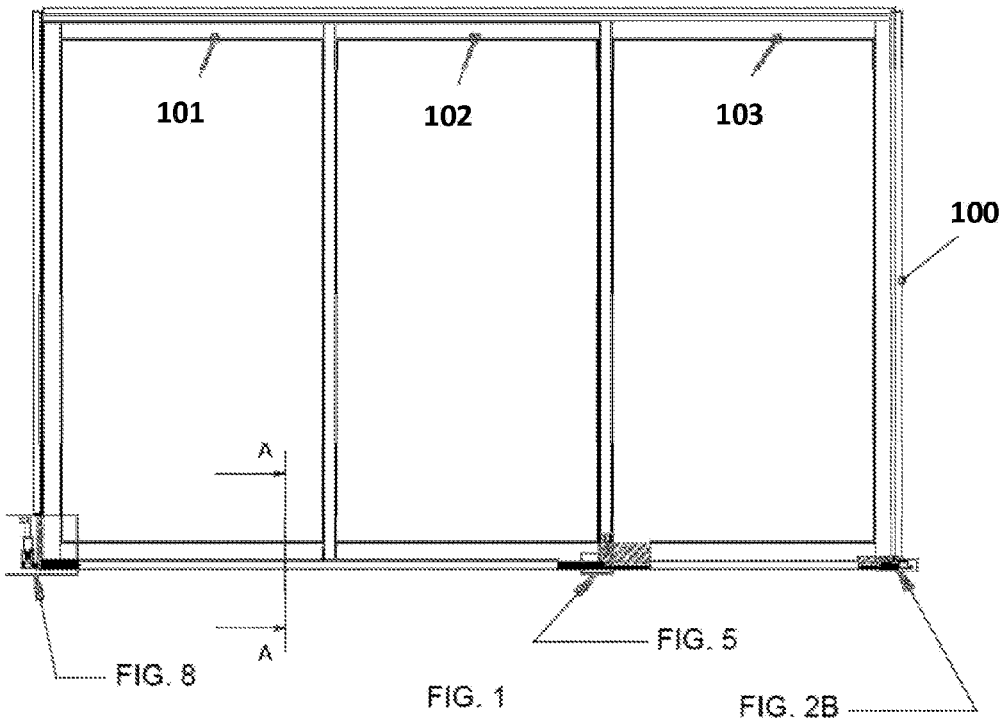
FIG. 1, shows an illustration of an opening comprising three motorized panes according to an embodiment of the technology.

The disclosure relates in one embodiment to motorized closure assembly. In another embodiment, the disclosure relates to motorized sliding windows and doors. Accordingly, provided herein are motorized closure assemblies, comprising: an opening frame configured to fit around the opening; a substantially rectangular closure slab having a closure slab frame configured to surround the substantially rectangular closure slab and sealingly fit within the opening frame; and a motorized driver, wherein the motorized closure assembly is entirely embedded within the closure slab frame or within a combination of the closure slab frame and the opening frame Detailed embodiments of the present technology are disclosed herein; however, it is to be understood that the disclosed embodiments are merely exemplary, which can be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

The terms "first," "second," and the like, herein do not denote any order, quantity, or importance, but rather are used to denote one element from another. The terms "a", "an" and "the" herein do not denote a limitation of quantity, and are to be construed to cover both the singular and the plural, unless otherwise indicated herein or clearly contradicted by context. The suffix "(s)" as used herein is intended to include both the singular and the plural of the term that it modifies, thereby including one or more of that term (e.g., the film(s) includes one or more films). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments.

In addition, for the purposes of the present disclosure, directional or positional terms such as "top", "bottom", "upper," "lower," "side," "front," "frontal," "forward," "rear," "rearward," "back," "trailing," "above," "below," "left," "right" "horizontal," "vertical," "upward," "downward," "outer," "inner," "exterior," "interior," "intermediate," etc., are merely used for convenience in describing the various embodiments of the present disclosure.

In an embodiment, provided herein is a motorized closure assembly, comprising: an opening frame configured to fit around the opening; a substantially rectangular closure slab having a closure slab frame configured to surround the substantially rectangular closure slab and sealingly fit within the opening frame; a driver, the driver concealed in a recess behind the opening frame and coupled to a driver pulley; a frame pulley, concealed in a recess behind the opening frame on a side opposite the driver; and a cable having a proximal end and a distal end, disposed between the frame pulley the driver pulley, and operably coupled to the slab frame wherein the driver, the cable, the motor pulley and the frame pulley are concealed regardless of the position of the closure slab in relation to the opening frame, the assembly capable of slidably moving the slab between an open position and a closed position.

Figure 12:
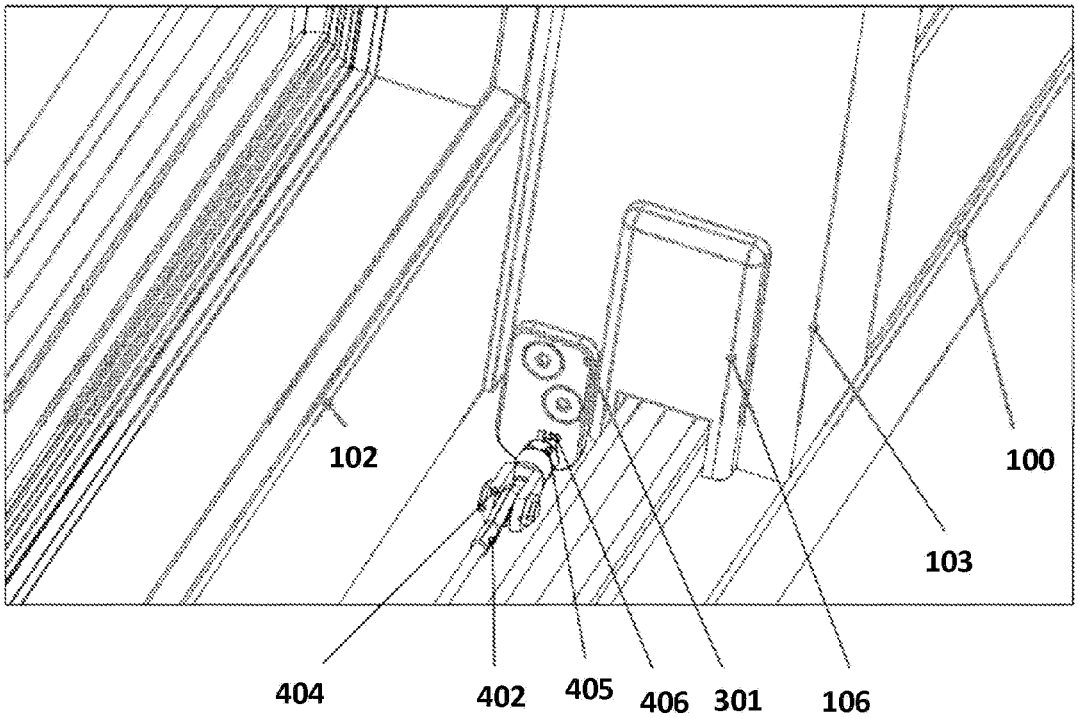
FIG. 12 shows an illustration of an internal pane cable coupling and assembly covering according to an embodiment of the technology.

As used herein, "concealed" means that the cable, the motor pulley and the slab frame pulley are sufficiently enclosed or embedded within the opening frame and/or the slab frame such that, in the normal and typical use of the motorized closure, the user does not typically come into contact with and/or get entangled in, and/or may observe the cable. Thus, the term "concealed" does not necessarily mean that the cable is completely hidden from view when the motorized closure slab is in use in the closed position. Rather, the cable may be slightly/partially visible, as can be seen in FIG. 12, but it is sufficiently recessed within and covered by the closure slab frame in normal use. the term "embedded" refers to the cable, the driver, the driver pulley, frame pulley or other free pulley described herein, being coupled firmly within a surrounding structure, or enclosed snugly or firmly within a material or structure, for example, the closure slab frame, the pane frame or the opening frame and their combination.

The term "coupled", including its various forms such as "operably coupling", "coupling" or "couplable", refers to and comprises any direct or indirect, structural coupling, connection or attachment, or adaptation or capability for such a direct or indirect structural or operational coupling, connection or attachment, including integrally formed components and components which are coupled via or through another component or by the forming process. Indirect coupling may involve coupling through an intermediary member or adhesive, or abutting and otherwise resting against, whether frictionally or by separate means without any physical connection.

The opening can be substantially rectangular or square. For example, an opening for a door or a window and the like. The substantially rectangular opening can have an aspect ratio with a longitudinal axis that is longer than a traverse axis. The longitudinal axis can be parallel with the closure sliding direction or perpendicular to the sliding direction. The closure slab or panes can have a top and bottom horizontal planes and proximal and distal vertical planes. The vertical distal plane defines the plane closest to the opening frame (in other words, the sill) in the closed position, while the vertical proximal plane defines the planes closest to the opening frame in the open position.

The slab can be opaque or have see-through clarity. "See-through clarity" as used herein refers to an easiness with which a target can be visually recognized through the slab and can be specified by total luminous transmittance and/or parallel luminous transmittance. As used herein, the see-through clarity is described to become lower as the luminous transmittance decreases. "See-through" encompasses any characteristic that allows visual inspection through the slab. Specifically, a viewing window, or the entire slab may be translucent, transparent, or entirely clear. "Translucent" indicates that light can pass through the slab, but the light is diffused. It does not require that a whole surface or an article itself is transparent and portions of the article may be transparent or opaque, for example to serve a function or to form a decorative pattern. The term "translucent" as used herein can refer to a slab composition that transmits at least 60% of electromagnetic radiation in the region ranging from 250 nm to 700 nm with a haze of less than 40%. The slab composition can also have a transmission of at least 75% for example, specifically at least 85%. Additionally, the slab composition can have a haze of less than 40% for example, specifically, a haze of less than 10%, more specifically a haze of less than 5%. The term "translucent" can also refer to a composition capable of at least about 40% transmission of light. The light referred to can be, e.g., actinic light (e.g., from a laser), emitted light (e.g., from a fluorochrome), or both, or transmittance of at least 80%, more preferably at least 85%, and even more preferably at least 90%, as measured spectrophotometrically using water as a standard (100% transmittance) at 690 nm. Likewise, "transparent" refers to a slab composition capable of at least 70% transmission of light.

The opening can be in a wall or defined between structural beams. The opening frame can be coupled to the opening, defining an opening frame, or a sill. For example, the opening frame can be comprised of a horizontal upper support beam, a lower horizontal guide rail and two vertical posts (in other words, jambs). The horizontal upper support beam can be coupled to the opening upper boundary, or to a ceiling beam and the like. The lower horizontal guide rail can be coupled to the floor.

The opening frame, and/or the closure slab frame (in other words, the slab frame and/or the frame surrounding the panes) can be made of the same or different material and can be any appropriate material, for example resin (thermoplastic or thermoset), or wood, or metal, or, for example aluminum or a combination comprising at least one of the foregoing, and/or their composites. Methods of forming the frame or parts thereof can be through extrusion molding, injection molding, thermoforming and the like. Likewise, the opening frame used in motorized closures described can be configured to accommodate a single slab or a plurality of slabs, or panes (slabs and panes are used interchangeably in an embodiment). Also, the closure slab (in other words, a window or a door without the attached frame), can be surrounded by a closure slab or closure pane frame that is configured to receive the motorized driver assemblies described herein. A sliding window, door or the like, as described herein can have at least two panes which extend in a generally vertical plane and at least one of which is movable generally horizontally, an opening frame (in other words, a sill) can include a channel that extends generally horizontally and within which bottom horizontal edge portions of each of the at least two panes are received, a dividing member within the channel which extends between the at least two panes, the dividing member extending either in contact with or in close facing relationship with the bottom edge portions of the at least two panes. The bottom of the channel in the opening frame can further include a rail extending generally horizontally and within which bottom edge portions of each of the at least two panes are engaged and slide upon. In another example, the pane frame can include a complementary channel configured to receive the rail. The pane can for example be an inner pane or an outer pane, referring to the relative position of the panes to the interior of the structure.

The slab or combination of panes, can seal the opening when in the closed position. The term "sealingly" as used herein is to be interpreted as substantially impeding airflow, moisture, particulates and the like though the junction and or opening.

The term "pane" is used principally to embody a glass sheet, which may or may not be a framed sheet. However, the term "pane" is not restricted to glass sheet and may for example include any transparent or opaque material, such as polycarbonate (transparent) or timber (opaque). The term is also intended to encompass double glazed units of two or more sheets of glass or other suitable material. In an embodiment, not all panes are motorized. For example, a closure opening can be closed with three panes have three independent pane frames wherein, only the external and mid panes are motorized with the assemblies, while the internal pane is not motorized. Closure slabs, or panes, motorized with the assemblies described herein can have a weight of up to 400 Kg, for example, between 5.0 Kg to 400 Kg, or 5.0 Kg to 300 Kg, specifically, between 5.0 Kg to 250 Kg, or between 120 Kg and 250 Kg, more specifically between 75 Kg and 200 Kg or between 100 Kg to 220 Kg.

The motorized driver used for sliding the panes along the path in the disclosure provided, can be a DC motor (direct current) or an AC motor (alternating current). The driver (in other words, a mechanical power transfer device) can also be a servo motor, an electric motor, a pneumatic motor and/or any other suitable electrical, mechanical, magnetic or other motor or driver that can apply a torque force upon a drive shaft operably coupled to the motor pulley. The driver can be configured to turn in two directions, namely clock-wise and counter-clockwise. The driver can be coupled to a motor pulley through a shaft. In addition, the mechanical power transfer device can further comprise: a gear box, a clutch (electromagnetic, mechanical, pneumatic or other suitable clutch mechanisms), drive shaft, brackets, and other components capable of assisting in power transfer from a motor to the driver pulley.

A frame pulley can be concealed in a recess behind the opening frame (e.g., the sill's vertical member horizontally opposite the driver pulley, for example, behind the jamb) and can be a part of an assembly comprising a base, a top flange and a shaft with the frame pulley being operably coupled to a ball bearing array disposed between the frame pulley and the top flange and between the frame pulley and the frame pulley base. The base can be coupled to a member disposed outside the opening frame, such that, for example, the shaft of the pulley is in parallel with the slab. The opening frame defines an orifice located in front of the frame pulley, allowing for communication between the cable and the frame pulley. The frame pulley can be disposed for example, at the top or bottom of the opening frame and be aligned with the slab or when a plurality of panes is used, be aligned with each pane. Alternatively, the frame pulley assembly can be embedded (in other words encased in, covered by, and/or enclosed) entirely within the closure slab frame or the pane frame.

A cable, having a proximal end and a distal end can be coupled at the cable's proximal end to the proximal bottom horizontal side of the slab or pane frame, meaning the side closest to the driver, through a first tension modulator, which can comprise a coupling bracket, a biasing element and a modulating screw capable of modulating the tension on the cable. The cable can loop around the driver pulley (e.g. to minimize slip), extend through an orifice in the opening frame, disposed in front of the driver pulley, wrap around the frame pulley and operably couple at the cable's distal end to the slab or pane frame, via a second tension modulator assembly. Modulating the tension on the cable can be used, for example, to prevent slip of the cable on the driver pulley.

The term "looped" means a path along which the cable moves, transit or extends in a cyclic and repetitive fashion, and wherein at least two points on the cable may be designated as occupying the same point or position (on or along the guide path, or along an axis perpendicular to the cable). In addition, the looped path (or track) may be further described as being a closed loop path. Furthermore, "looped" or similar used in the description does not only refer to a perfect circular ring shape, but rather is a general term which encompasses an elliptical ring, a square ring, a polygonal ring shape or the like, to indicate any shape of an object defining a preferable closed region. In addition, the term "wrapped" as used herein, refers to circumstances where the cable is wound around a portion of the circumference of the pulley that is less than the whole circumference.

The slab or panes can be slidably coupled to the opening frame (or, in other words the sill). The driver can be configured to slidably move the panes or slab along the appropriate track on the opening frame (in other words, the sill) at speeds of, for example, between 5.0 to 100 cm/sec., specifically, between 5.0 to 60 cm/sec., or between 5.0 to 30 cm/sec., more specifically, between 5.0 to 25 cm/sec., or between 5.0 to 15 cm/sec. The term "slidably coupled" is used in its broadest sense to refer to elements which are coupled in a way that permits one element to slide or translate with respect to another element.

Likewise, the distal and proximal tension modulators described herein can impart a normal operating static load on the tensioned cable that could be, for example, between about 1.0 Kg to 100 Kg, specifically, between about 2.0 Kg to 60.0 Kg, more specifically, between about 4.0 Kg to 12.0 Kg, for example, 5 Kg for motorized closure assemblies and systems involving cables (outside diameter (od) of 1-4 mm). The normal operating static load imparted by the tension modulators used in the assemblies described herein, can be configured to create a static friction that will not be exceeded during normal operation of the drivers and pulleys provided, thus ensuring no slip will occur between the cable and the pulleys. The ability to modulate the tension using the tension modulators described herein, on the cable, can be beneficial to ensure no slip occurs between the cable and pulleys, as well as to dampen the stress on the cable and the motor's drive shaft following initiation of motion upon receipt of the proper command from a command and control module (CCM) in electronic communication with the driver. Initiation of motion in any of the motorized closure assemblies can be done once the CCM has verified that any locking means are disengaged. For example, a locking means comprising a pin wherein the pin is electromagnetically actuated between a recessed position within the closure slab or pane frame and an open position protruding outside of the closure slab or pane frame, and inserted into the opening frame and/or an adjacent pane frame, can be actuated by the CCM. Prior to initiation of motion of the motorized closure assemblies described, the CCM verifies that the locking pin is in the recessed position, if the pin is in the recessed position, then the motion of the closure slab or pane using the assemblies described herein will be initiated. Else, the pin can be recessed and motion initiated or an alert can be provided to the user.

In an embodiment, provided herein is a drivetrain for a motorized closure assembly, comprising: a leveling assemble; and a mobilizing assembly, wherein the mobilizing assembly comprises: a driver; a clutch; a gear box; and a track wheel coupled to the gear box, the track wheel configured to engage a rail. The rail can be disposed, for example, within a channel in the horizontal frame base, configured to receive the closure slab frame or pane frame, extending the length of the channel.

The motorized closure assembly, comprising: an opening frame configured to fit around the opening; a substantially rectangular closure slab having a closure slab frame configured to surround the closure slab and sealingly fit within the opening frame can comprise a first drivetrain embedded within and operably coupled to the closure slab frame or pane frame. The leveling assembly can comprise an adjustment screw, threaded through an adjustment screw bracket coupled to attachments means configured to couple the leveling assembly to the closure slab frame or the pane frame. The tip of the adjustment screw opposite the screw head can be configured to have channels extending perpendicular to the longitudinal axis of the adjustment screw, configured to slidably couple in a groove defined in the posterior end of a leveling assembly. The leveling assembly can have a beveled anterior end (in other words, creating a wedge), configured to slidably couple to an oppositely slanted mobilizing assembly posterior end, such that turning the adjustment screw will cause the leveling assembly to slide between a bottom surface of the closure slab frame or the pane frame, and the mobilizing assembly, causing the closure slab frame or the pane frame to lift in relation to the rail. The mobilizing assembly can be hingedly coupled to the closure slab frame or the pane frame at the anterior end. The motorized systems described herein can have a first and a second drivetrains embedded within and operably coupled to the closure slab frame or the pane frame.

Figure 16:
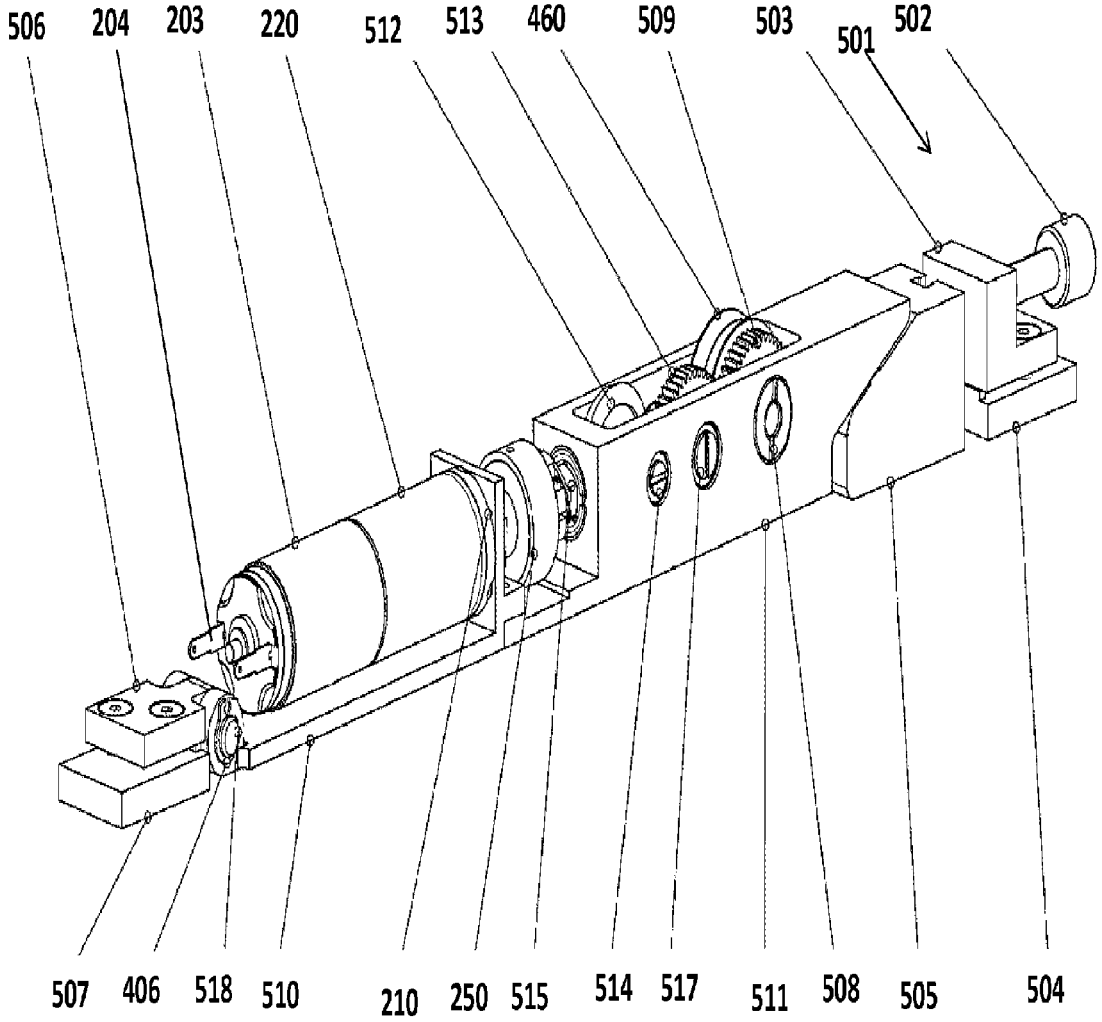
FIGS. 16-18 shows an illustration of an isometric view (FIG. 16), side view (FIG. 17) and top view (FIG. 18) of a drivetrain according to an embodiment of the technology.
Figure 17:
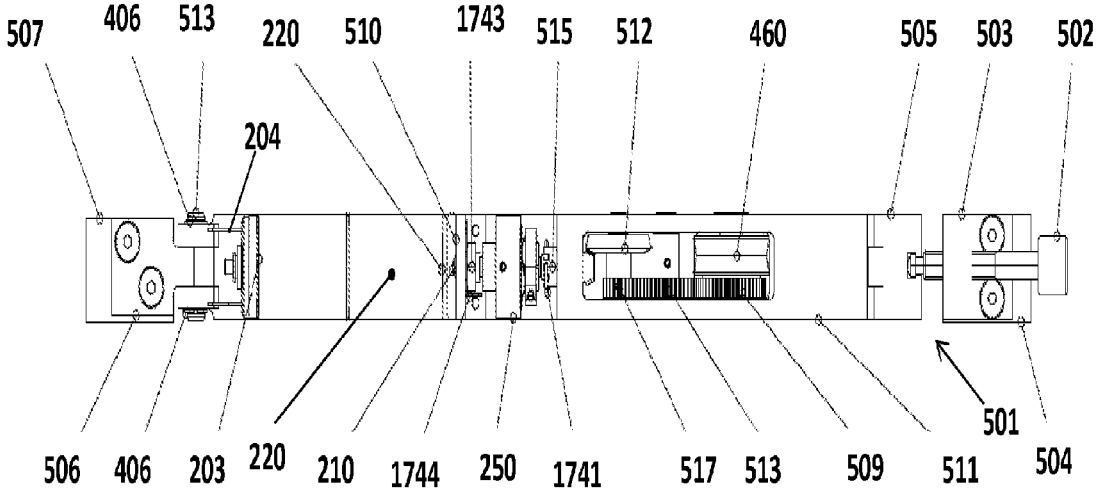
Figure 18:
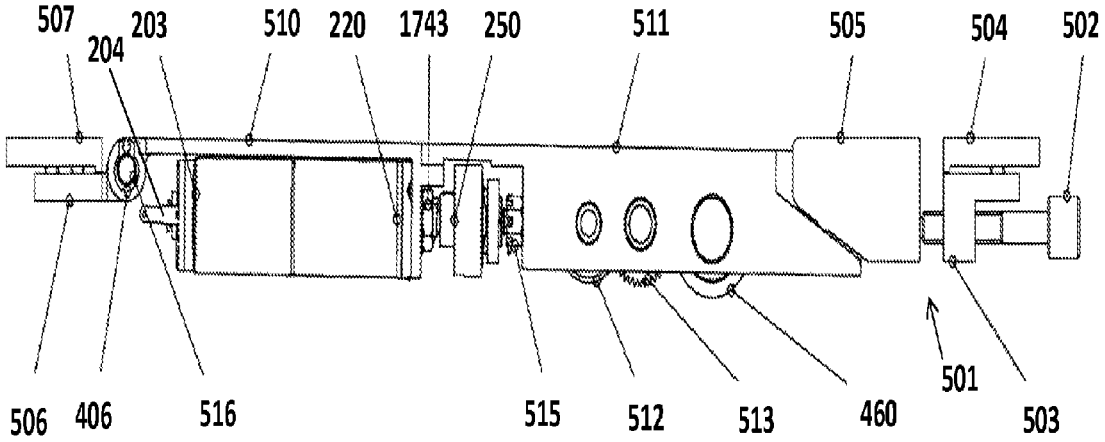

The first and second drivetrain can comprise a driver; a clutch; a gear box, a track wheel the track wheel configured to engage a rail on the closure frame (or in other words, the sill). The gearbox can comprises, for example, a beveled gear; and at least one spur gear, wherein the at least one spur gear is operably coupled to the track wheel, the track wheel configured to engage a rail on the opening frame. The gear assembly (or gear box) can also include the elements such as shown in FIGS. 16-18 and/or can include any other suitable gears, pulleys, belts, chains and/or any other drive element know to those skilled in the art of power transmission, such as to transfer driving forces from a driver to a driven element (for example, the track wheel. The term "drivetrain" is used in its broadest sense to refer to the combination comprising the leveling assembly, the adjustment screw, the adjustment screw bracket and frame coupling means, the driver motor, the driveshaft, the transmission assembly, the clutch, the housing and the slab attachment means and the track wheel. However, other elements, such as the bottom part of the slab or pane frame can be a part of the drivetrain. In a specific example, the number and location of the drivetrain can be varied and be between 1 and 4 drivetrain assemblies, located for example, along the bottom horizontal plane of the closure slab or closure pane or at the top plane of the closure slab or closure pane. Upon receipt of a command from a command and control module (CCM), in electronic communication with the drivetrain(s), when, for example, two drivetrain assemblies are coupled to the closure slab frame or closure pane frame, movement of the first drivetrain in one direction can be initiated.

Upon power failure or selection by a user on the CCM, the clutch, for example, an electromagnetic clutch can disengage the driver motor from the gear box, allowing for manual opening or closing of the slab or pane. It would be recognized that a similar clutch can be disposed between the drive shaft of the driver motor and the driver pulley described in the assemblies provided throughout this disclosure, enabling the same operations.

The drivetrain assembly can be located at the top plane of the pane closure, moving the track wheel along a shelf in the opening frame such that the track wheel and the gear assembly hangs on the rail attached on the shelf in the sill. The drivetrain can further comprise coupling means to operably couple the drivetrain to the closure slab or pane frame. The coupling means can comprise hinges, attachment members and the like, which may be used to attach the drivetrain to the frame of the closure slab or pane. In a specific example, a pane frame having a profile that can be configured retroactively to receive the drivetrain disclosed herein is provided with a drivetrain as described herein, thereby enabling the pane to move upon receipt of a command from a control module.

In another embodiment, provided herein is a motorized closure assembly, comprising: an opening frame configured to fit around at least the top horizontal side, a distal vertical side, and a bottom horizontal side of a substantially rectangular opening; a substantially rectangular closure slab having a closure slab frame configured to surround the substantially rectangular closure slab and sealingly fit within the opening frame; a driver, the driver embedded within a proximal (e.g., to the drive motor) vertical side of the substantially rectangular closure slab frame and coupled to a driver pulley; a frame pulley, can be embedded within and coupled to a distal horizontal side of the substantially rectangular closure slab on a horizontal side opposite the driver pulley. The driver pulley and the frame pulley can be disposed such that both are on the same level, while the driver body extends above the driver pulley. A first free pulley can be disposed between the driver pulley and the frame pulley and operably coupled to the closure slab frame. Depending on the span of the bottom horizontal side of the closure slab frame or the pane frame, and/or the weight of the closure slab frame or the pane frame, more than one free pulleys can be employed. In addition, a cable can connect the motor pulley, the first free pulley and the frame pulley, wherein the cable and the free pulley are embedded within the closure slab frame (e.g., the lower horizontal side of the closure slab frame or the pane frame).

Pocket door systems have become an increasingly preferred door system in the construction of residential and commercial building structures in which room space is limited. The pocket door system can include a header assembly having a track on which trolley assemblies are slidably coupled for translational movement. A door can be suspended from the trolley assemblies and is, therefore, capable of movement between a closed position and an open position wherein, in the open position, the door can be concealed within a pocket formed in the surrounding wall structure. Such a door system offers the advantage over standard hinged door arrangements in that dedication of floor space is not required to open the door from a closed position. The motorized closure assemblies described herein can be used for example to impart motion to pocket doors.

The first free pulley can be operably coupled to the closure pane or closure slab frame via a bracket, the bracket can be coupled to the frame directly and be configured not to interfere with the sliding motion of the closure slab or pane. The first bracket can be operably coupled to the first free pulley, and the first free pulley can be positioned in parallel with the closure slab. Likewise, the first bracket can be operably coupled to the first free pulley, where the first free pulley can be positioned in parallel with the closure slab at an anterior side of the bracket and coaxially coupled to a first track wheel. Also, the second free pulley can be operably coupled to the closure pane or closure slab frame via a bracket. The second bracket can be operably coupled to the first free pulley, where the first free pulley can be positioned in parallel with the closure slab at an anterior side of the bracket, and coaxially coupled to a second track wheel. The first and second track wheel can be configured to engage and rollingly travel along a rail dispose within a channel defined by the horizontal bottom, or base of opening frame.

The cable can be a closed loop, looping around the driver pulley (e.g., the motor pulley) and the first free pulley and optionally the second free pulley, while wrapping around the frame pulley. The frame pulley can be coupled to the closure slab or closure pane frame via an assembly, which in turn can comprise a tension modulator.

Upon receipt of command from the CCM, the driver can be activated to turn the driver pulley (e.g., the motor pulley) either clockwise or counterclockwise turning the driver pulley in a corresponding direction, causing the cable to rotate the first free pulley, coupled to the closure slab or closure pane frame, rotate the track wheel, thereby causing the slab or pane to slidably move from an open to closed position or from a closed to an open position. In a specific example, the cable can loop around at least a second free pulley as described herein. The skilled artisan will recognize, that the number of free pulleys used in the motorized closures described herein, can depend on, for example, the span of the opening, the weight of the closure slab, the size of the driver, the available packaging space within the closure slab frame, or a combination comprising at least one of the foregoing.

The cable can be made of any material appropriate for the necessary tension. The use of cable described indicates that the cable be able to survive high tensile loading. The closing and opening motion of the closures described may require that the umbilical or tether cable provide for the bi-directional motion. It may be beneficial to have innate low elongation characteristics, preventing the fibers of the cable from stretching, hence the need for low elongation, high tensile strength fibers. The cable can, for example be a high strength stainless or galvanized steel rope for that purpose. Alternatively, the cable can be made of Kevlar (in other words, a para-aramid synthetic fiber) or Vectran (an aromatic polyester produced by the polycondensation of 4-hydroxybenzoic acid and 6-hydroxynaphthalene-2-carboxylic acid), or Technora (condensation polymerization of terephthaloyl chloride (TCl) with a mixture of p-phenylenediamine (PPD) and 3,4'-diaminodiphenylether (3,4'-ODA)) and the like ropes and braided fibers having an elongation of no more than 10%. With proper placement in the cable and suitable termination or anchoring techniques the rope can provide a dual role. The cable diameter can be between 1 and 5 millimeter for example, having a breaking strength of between 50 and 1000 Kg, and can be sheathed (in other words jacketed) in a resin to increase the friction between the cable and the driver pulley and the frame pulley.

A more complete understanding of the components, processes, assemblies, and devices disclosed herein can be obtained by reference to the accompanying drawings. These figures (also referred to herein as "FIG.") are merely schematic representations (e.g., illustrations) based on convenience and the ease of demonstrating the present disclosure, and are, therefore, not intended to indicate relative size and dimensions of the devices or components thereof and/or to define or limit the scope of the exemplary embodiments. Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

Turning now to FIGS. 1-9, showing, in FIG. 1, a side view of opening frame 100 where each of three panes; internal pane 103, mid pane 102, and external pane 101 are enclosed by pane frame. Cut-aways point to corresponding detailed drawings in FIGS. 2B, 5 and 8 with section A-A illustrated in detail in FIG. 4.

Figure 2:
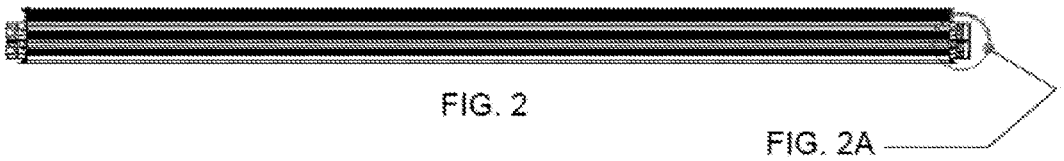
FIGS. 2, 2A and 2B, shows an illustration of an opening frame according to an embodiment of the technology where
Figure 2A:
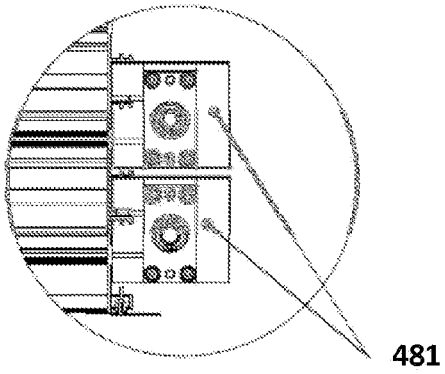

FIG. 2, illustrates a bottom view of opening frame 100 shown in FIG. 1 indicating the location of the frame pulleys (right, FIG. 2A) and driver pulley base (Left, not indicated). FIG. 2A shows the base 481 of frame pulley 480 (not marked) assembly (see e.g., FIG. 9C) where each frame pulley assembly is aligned with the track corresponding to the pane sought to be moved (e.g. frames 102 and 103). As shown in FIG. 1, not all panes must be motorized and only panes 102 and 103 are motorized. Pane 101 can, for example, by static or mobilized manually and be a sliding door or a pivoting door (or both sliding and pivoting).

Figure 2B:
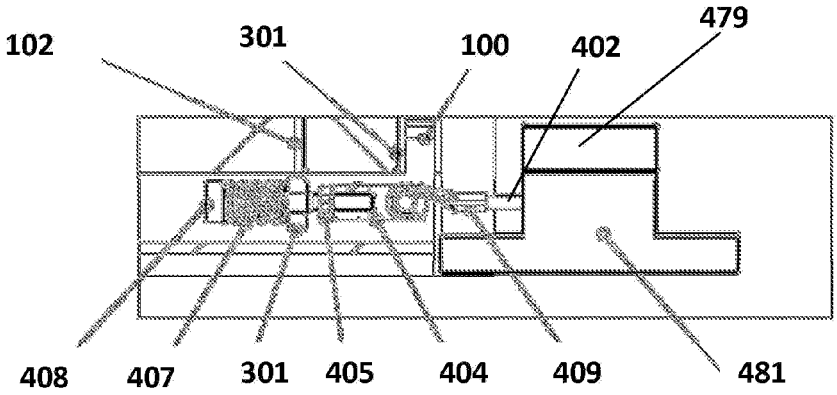

Turning now to FIG. 2B, showing the proximal coupling of pane frame 102 to frame pulley 480 (not shown) enclosed between frame pulley base 481 and frame pulley top flange 479 connected to tension modulator assembly. The tension modulator assembly can comprise, for example, back screw 408 coupled to cable 402 through an orifice defined in coupling bracket 301 with biasing element 407 disposed between the coupling bracket and the head of back screw 408, the back screw being coupled (for example by a threading) to socket (e.g. a Spelter socket) 404 with optionally a locking bolt 405 limiting the movement of back screw 408 in relation to socket 404. Plug 409 shown as well.

Figure 3:
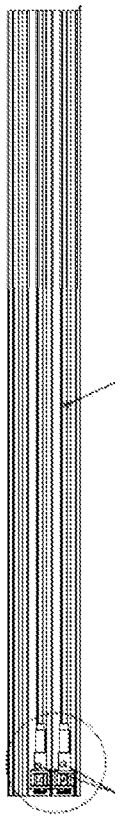
FIG. 3 shows an illustration of the driver according to an embodiment of the technology, where
Figure 3A:
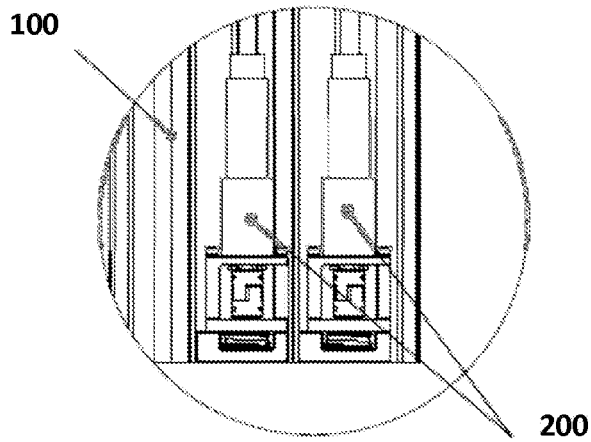
FIG. 3A illustrates an embodiment of the location of the driver in relation to the opening frame.
Figure 3B:
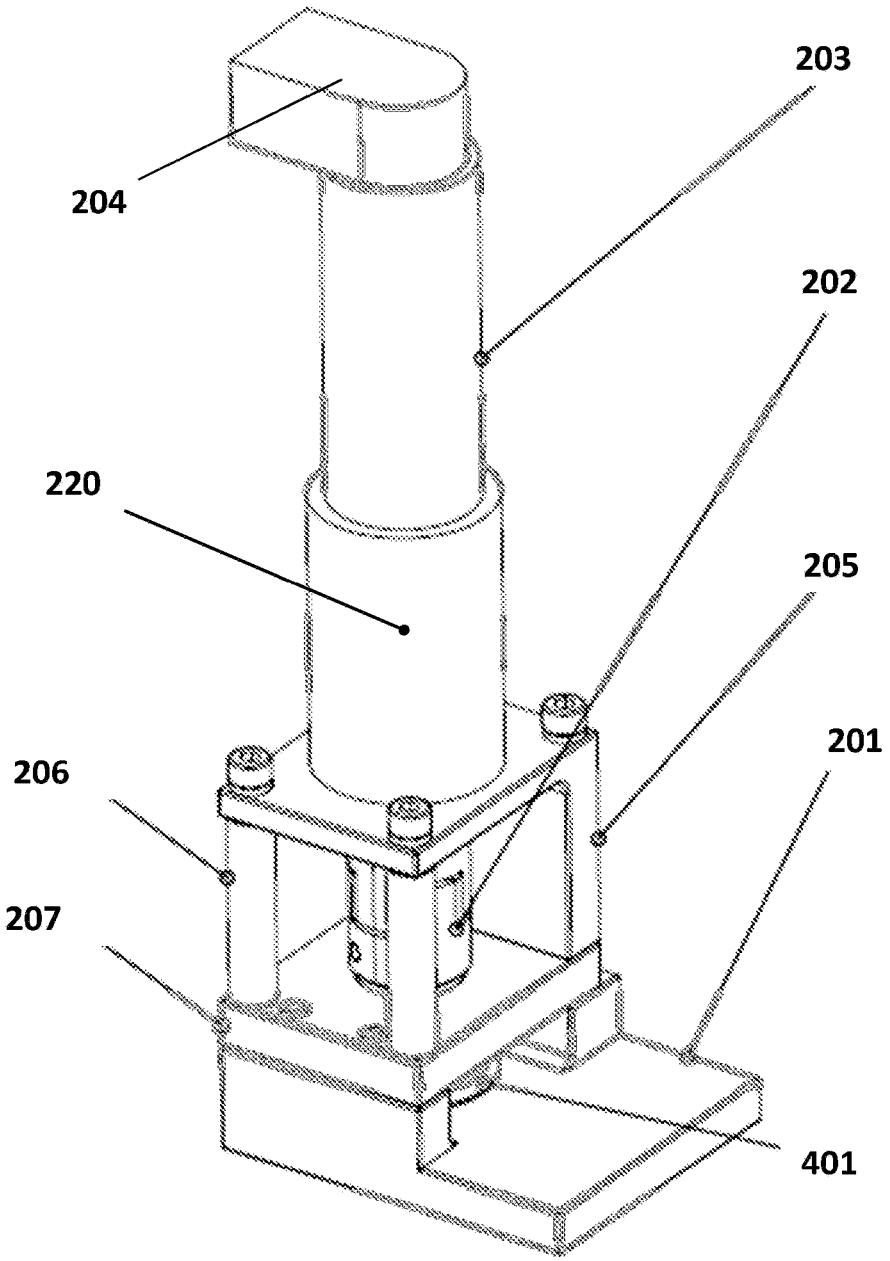
FIG. 3B shows an illustration of the driver.

Turning now to FIG. 3, showing rear view of the proximal vertical post of opening frame (e.g., sill) 100 with drivers 200 aligned in a recess in the structural wall for example, with the pane or slab (e.g., 102 and 103) sought to be mobilized or motorized (FIG. 3A). Driver motor 200 is shown in FIG. 3B, with driver pulley 401 assembly having driver pulley base 201 connected to driver pulley assembly's top flange 207, housing driver pulley 401 and optionally a bearing array (not shown) disposed between driver pulley 401 and top flange 207, and between driver pulley 401 and driver pulley base 201. The shaft of driver pulley 401 extends above driver pulley assembly's top flange 207, optionally terminating in coupling assembly 202 having a bottom member operably coupled to driver pulley 401 and a top member coupled to driver motor 203 which is coupled to planetary gear box 220, which in turn, can be coupled to driver pulley assembly's top flange 207 via driver bracket 205 and spacers 206. Electric connection leads 204 are shown with cover. Planetary gear box can have, for example a 1:1 to 1:7 transmission ratio from motor 203 drive shaft to driver pulley 401. Coupling assembly 202 can be replaced, for example with an electromagnetic clutch (250, not shown, see FIG. 16). Alternatively, pulley 401 can be driven directly by drive shaft extending from planetary gear box 220 and no coupling assembly is involved.

Figure 4:
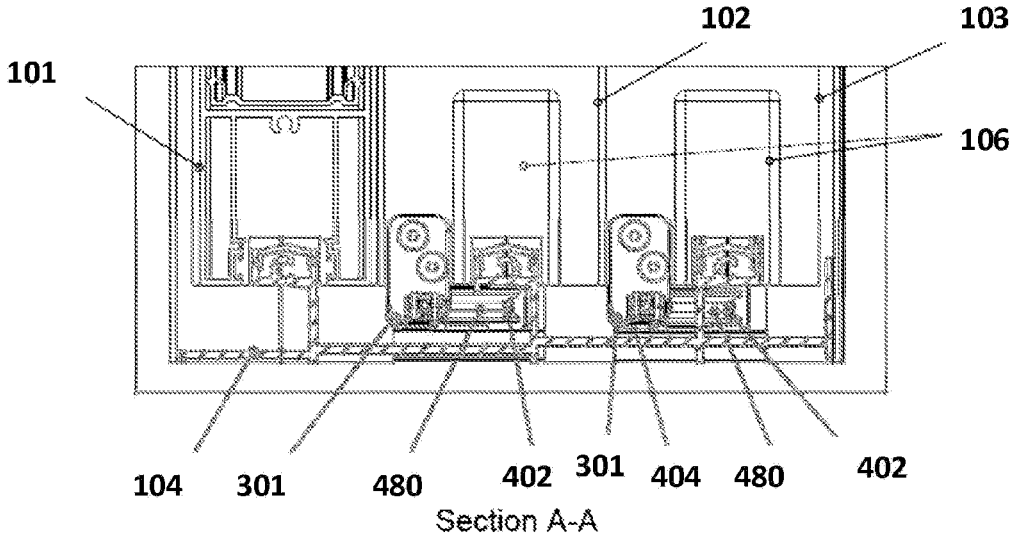
FIG. 4 shows an illustration of section A-A from FIG. 1 according to an embodiment of the technology.

Turning now to FIG. 4, showing FIG. 1 section A-A, with sill 100 defining channels where internal pane frame 103 is operably coupled to cable 402 wrapping around frame pulley 480 and attached to coupling bracket 301 with socket 404. As shown, cover 106 partially cover orifice defined in pane 103 frame. Cover 106 can be removed when necessary to facilitate access to tension modulator screw 408 (e.g., FIG. 2B) to adjust tension on cable 402, access frame pulley 480 or other components of the assembly described herein. Sill 100 has a bottom profile 104 defining channels dividers and rails facilitating the slidable coupling of the pane frame and its motion.

Figure 5:
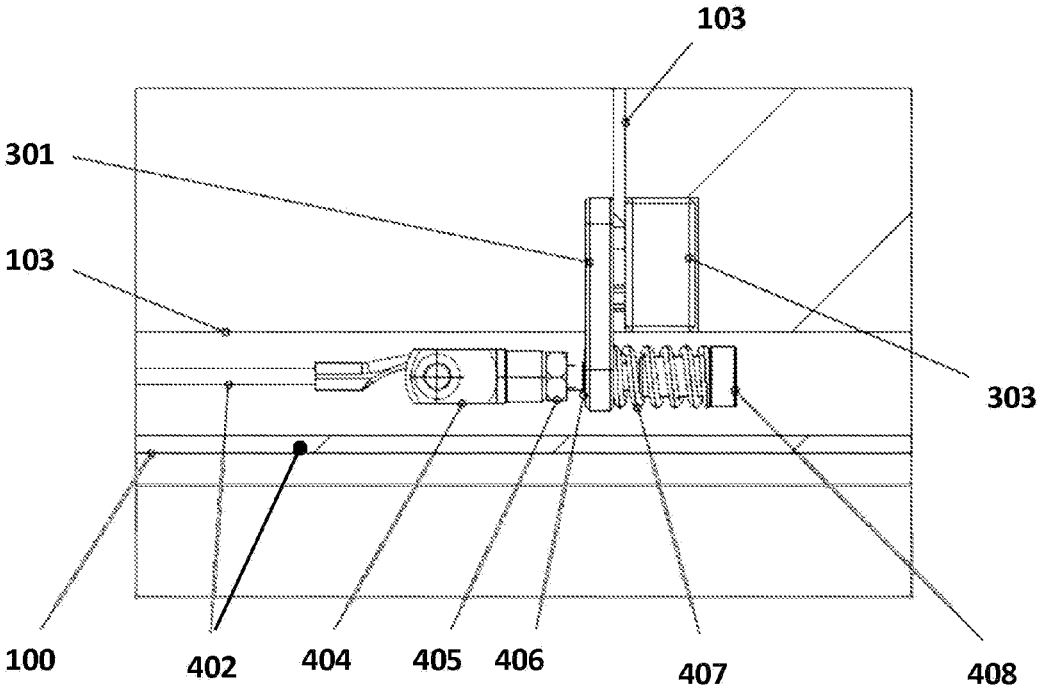
FIG. 5 shows an illustration of the coupler of the cable tension modulator to the closure frame according to an embodiment of the technology.

Turning now to FIG. 5, showing the distal cable end coupling of cable 402 to pane frame 103, with coupling bracket 301 coupled to coupling bracket backing 303, C-clamp 406 can be used to restrict movement of back screw 408. Closure slab frame 103 (as well as frames 102 and 101) can have thickness of between 0.5 to 3 mm and can have fixed or variable thickness along the frame. Pane frames 102, and 103 can be similarly dimensioned or can have different thickness. As shown, back screw 408 can be coupled to cable 402 through an orifice defined in coupling bracket 301 attached through pane frame 103 to coupling bracket backing 303, with biasing element 407 disposed between coupling bracket 301 and the head of back screw 408, the back screw 408 being coupled (for example by a threading) to socket (e.g. Spelter socket) 404 with optionally a locking bolt 405 limiting the movement of back screw 408 in relation to socket 404. Cable 402 can be looped around driver pulley 401 (not shown), extending to proximal end as shown in FIG. 2B, wrapping around frame pulley 480 (not shown).

Figure 6:
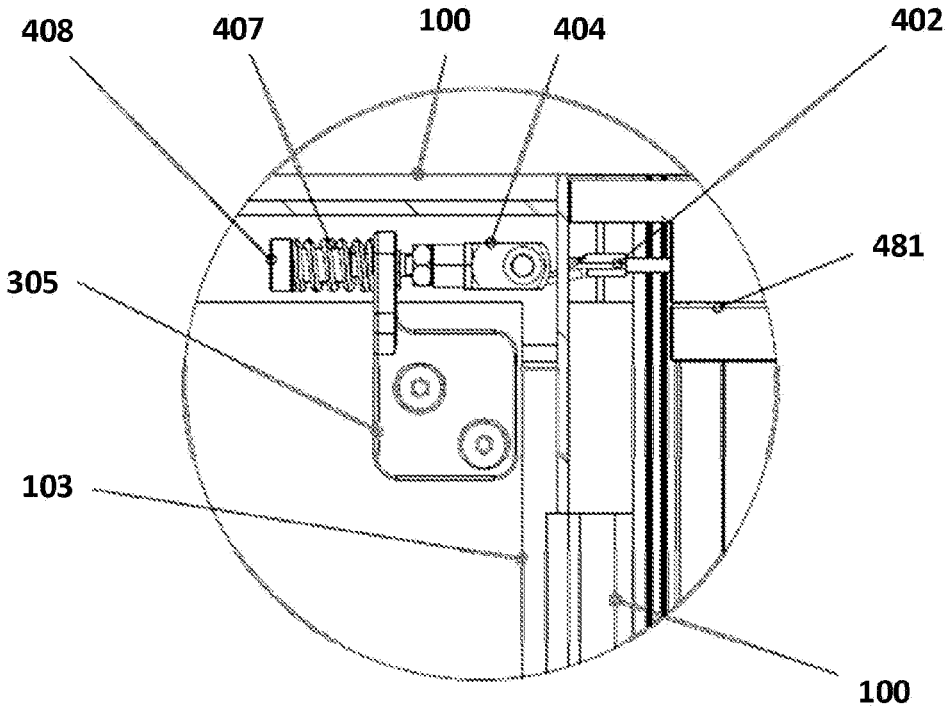
FIG. 6, shows an illustration of the coupler of the cable tension modulator to the closure frame in relation to the frame pulley disposed on the top of the closure slab according to an embodiment of the technology.
Figure 7:
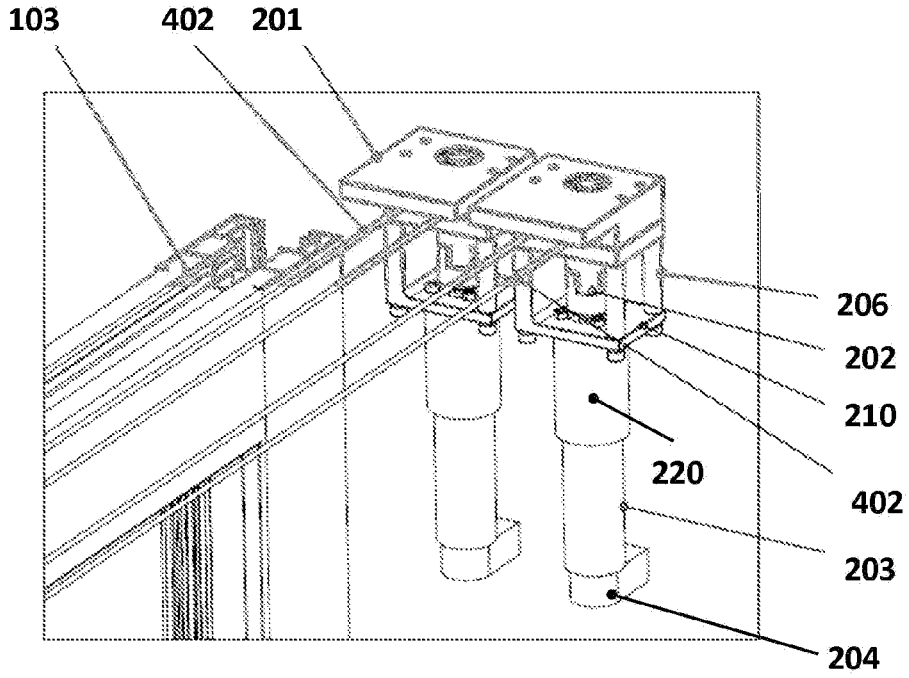
FIGS. 7 and 8 show an illustration of the driver in relation to the closure slab frame according to an embodiment of the technology.

FIGS. 6 and 7 show a configuration where driver pulley assembly base 481 is coupled to closure pane frame 103 with proximal cable coupling that can be coupled to tension modulator assembly comprising back screw 408 coupled to cable 402 through an orifice defined in top coupling bracket 305 with biasing element 407 disposed between the top coupling bracket 305 and the head of back screw 408, the back screw being coupled (for example by a threading) to socket (e.g. Spelter socket) 404.

The term "biasing element" refers to any element that provides a biasing force. Representative biasing elements include but are not limited to springs (e.g., elastomeric or metal springs, torsion springs, coil springs, leaf springs, tension springs, compression springs, extension springs, spiral springs, volute springs, flat springs, and the like), detents (e.g., spring-loaded detent balls, cones, wedges, cylinders, and the like), pneumatic devices, hydraulic devices, magnets, and the like, and combinations thereof. Likewise, "biasing element" as used herein refers to one or more members that applies an urging force between two elements, for example, urging pane frame 101 away from top coupling bracket 305.

Turning now to FIG. 7, showing the driver configuration opposite FIG. 6, where driver 200 showing inverted configuration of driver pulley 401 (not shown) assembly having driver pulley base 201 connected to driver pulley assembly's top flange 207 (not shown), housing driver pulley 401. The shaft of driver pulley 401 extends below driver pulley assembly's top flange 207 (not shown), terminating in coupling assembly 202 having a bottom member operably coupled to driver pulley 401 and a top member coupled to driver motor 203 which is coupled to planetary gear box 220, which can be coupled to driver pulley assembly's top flange 207 (not shown), via driver bracket 205 and spacers 206. Electric connection leads 204 are shown with cover. As shown, the motorized closure assembly can be on the same level (e.g., top horizontal or bottom horizontal sides of the frame) or at opposite levels for each pane. Accordingly, in a specific example, the driver assembly is not in the same relative location as the driver assembly of the adjacent pane.

Figure 8:
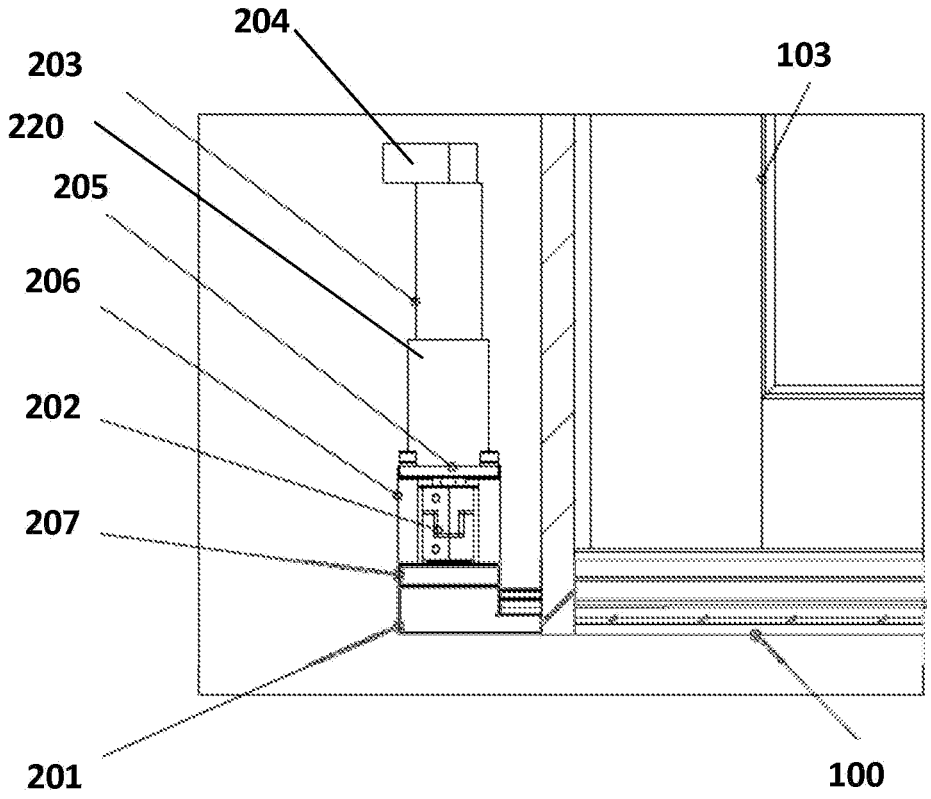

FIG. 8. illustrates the relative configuration in a side view, of driver 200 recessed behind opening frame (sill) 100, showing driver pulley 401 assembly having driver pulley base 201 connected to driver pulley assembly's top flange 207, housing driver pulley 401 (not shown), and optionally a bearing array (not shown). The shaft of driver pulley 401 extends above driver pulley assembly's top flange 207, terminating in coupling assembly 202 having a bottom member operably coupled to driver pulley 401 and a top member coupled to driver motor 203 which is coupled to planetary gear box 220, which can be coupled to driver pulley assembly's top flange 207 via driver bracket 205 and spacers 206. Electric connection leads 204 are shown with cover. FIG. 8 further illustrates the location of cable 402 embedded within the horizontal bottom side of the closure slab frame or the pane frame, thus being concealed.

Figure 9B:
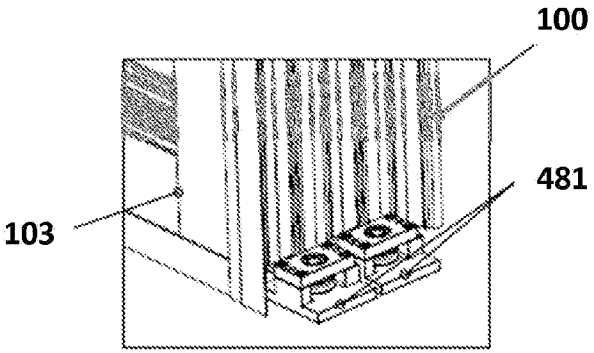
FIGS. 9A and 9B show an opening defined in the opening frame and FIG. 9C shows the frame pulley assembly.
Figure 9A:
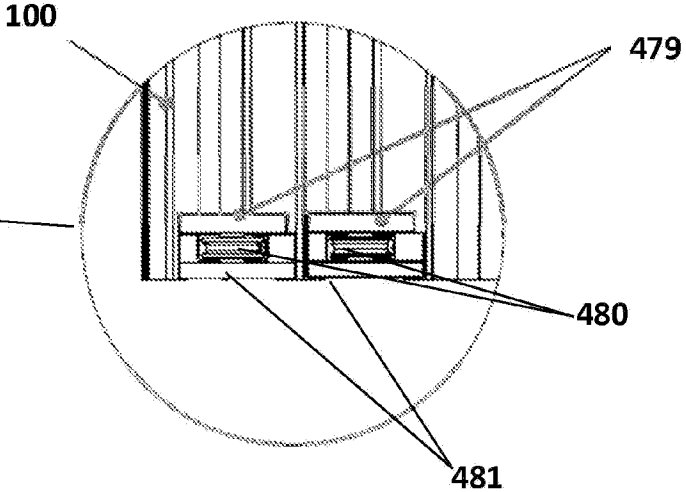
Figure 9:
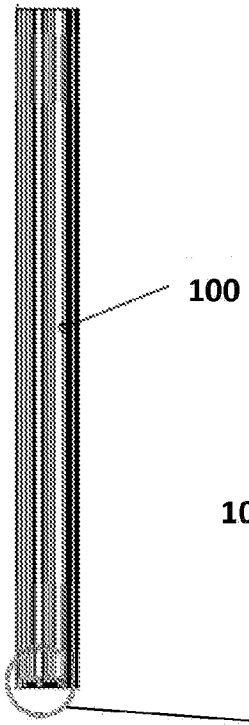
FIG. 9 shows an illustration of the frame pulley assembly, where
Figure 9C:
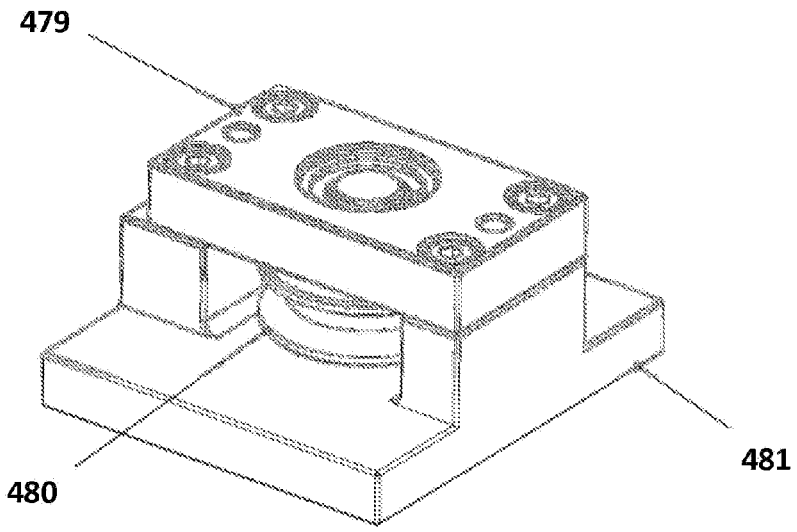

Turning to FIG. 9, showing front view of FIG. 1, where FIG. 9A (front vie, enlarged) and 9B (isometric view) illustrate the space defined in the distal vertical post of the opening frame (e.g., jamb) 100 creating the communication between frame pulley 480 and closure pane frame 103, 102. Where as shown in FIG. 9C, frame pulley 480 is sandwiched between base 481 and frame pulley assembly's top flange 479, which can optionally comprise ball bearing array between frame pulley 480 and base 481, and between frame pulley 480 and frame pulley top flange 479.

Figure 10:
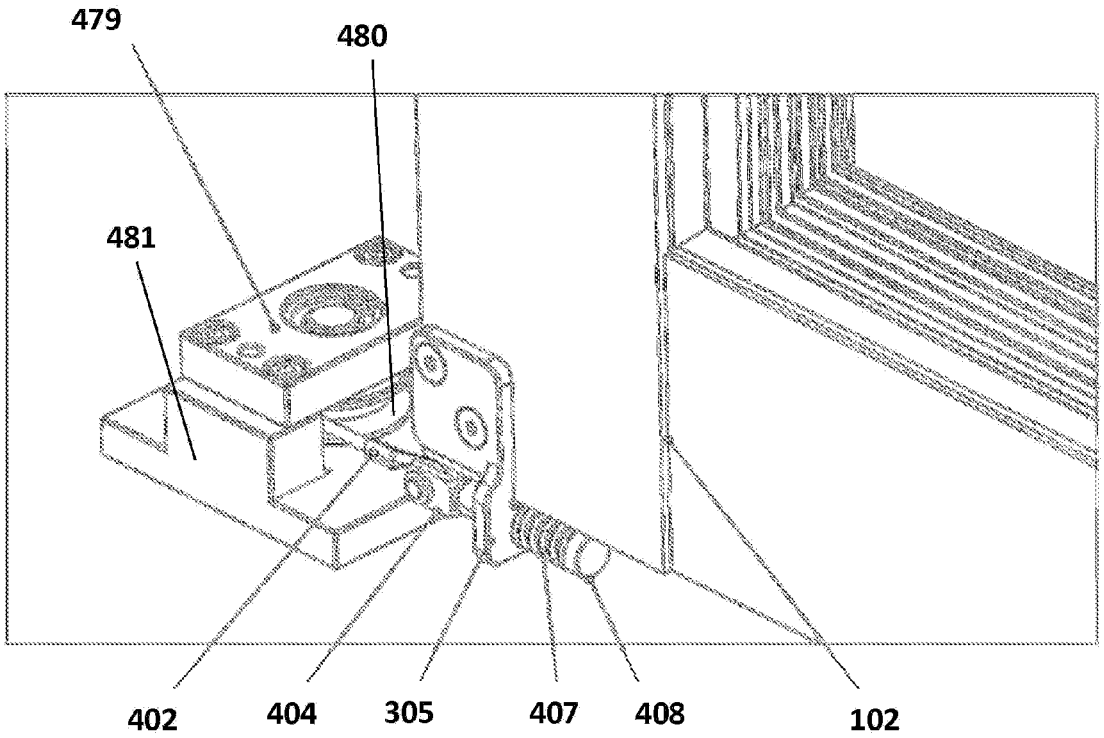
FIGS. 10 and 11 show an illustration of the cable coupling the frame pulley assembly and the tension modulator coupling to the closure slab frame at the bottom of the closure slab frame in a top right isometric view (FIG. 10), and at bottom view of the closure slab frame (FIG. 11)
Figure 11:
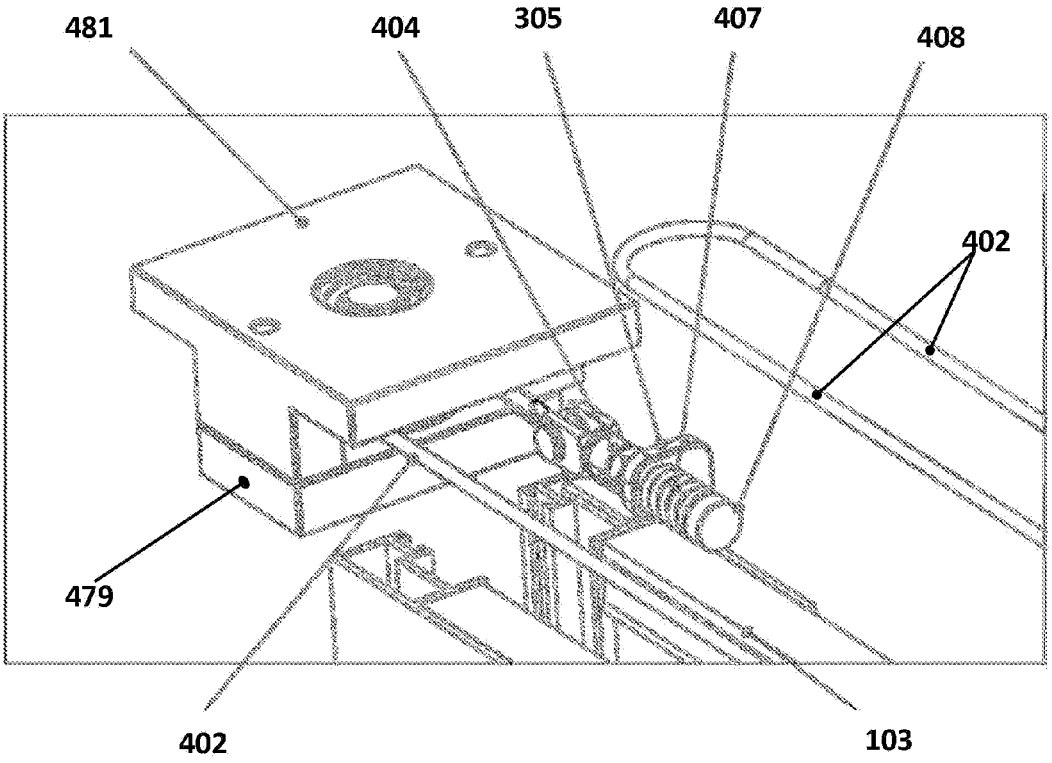

Turning now to FIGS. 10-13, showing an example of the configuration of coupling of cable 402 to pane frame 102. As shown in FIG. 10, the proximal coupling of pane frame 102 to frame pulley 480 enclosed between frame pulley base 481 and frame pulley top flange 479 connected to tension modulator assembly, the assembly comprising, for example, back screw 408 coupled to cable 402 through an orifice defined in bottom coupling bracket 305 with biasing element 407 disposed between the coupling bracket and the head of back screw 408, the back screw being coupled (for example by a threading) to socket (e.g. Spelter socket) 404. As shown, cable 402 can be wrapped or be partially wound around pulley 480. Likewise, FIG. 11 shows a bottom isometric view of FIG. 10, showing proximal cable end coupling of pane frame 103 to frame pulley 480 enclosed between frame pulley base 481 and frame pulley top flange 479 connected to tension modulator assembly, the assembly comprising, for example, back screw 408 coupled to cable 402 wrapping around frame pulley 480 through an orifice defined in bottom coupling bracket 305 with biasing element 407 disposed between the coupling bracket and the head of back screw 408, the back screw being coupled (for example by a threading) to socket (e.g. Spelter socket) 404. Illustrated as well, is the cable configuration of pane 102 around frame pulley 480 associated therewith (not shown for clarity, illustrating the wrapping of cable 402)

FIG. 12 shows distal cable end coupling of cable 402 to pane frame 103, with coupling bracket 301 coupled to coupling bracket backing 303 (not shown), C-clamp 406 can be used to restrict movement of back screw 408 (not shown). As previously indicated, back screw 408 can be coupled to cable 402 through an orifice defined in coupling bracket 301 attached through pane frame 103 to coupling bracket backing 303 (not shown), with biasing element 407 (not shown), disposed between coupling bracket 301 and the head of back screw 408, the back screw 408 being coupled (for example by a threading) to socket (e.g. Spelter socket) 404 with optionally a locking bolt 405 limiting the movement of back screw 408 in relation to socket 404. As shown, cable 402 is wrapped around driver pulley 401 (not shown), extending to proximal end as shown in FIG. 2B, wrapping around frame pulley 480 (not shown) and covered by cover 106.

Figure 13:
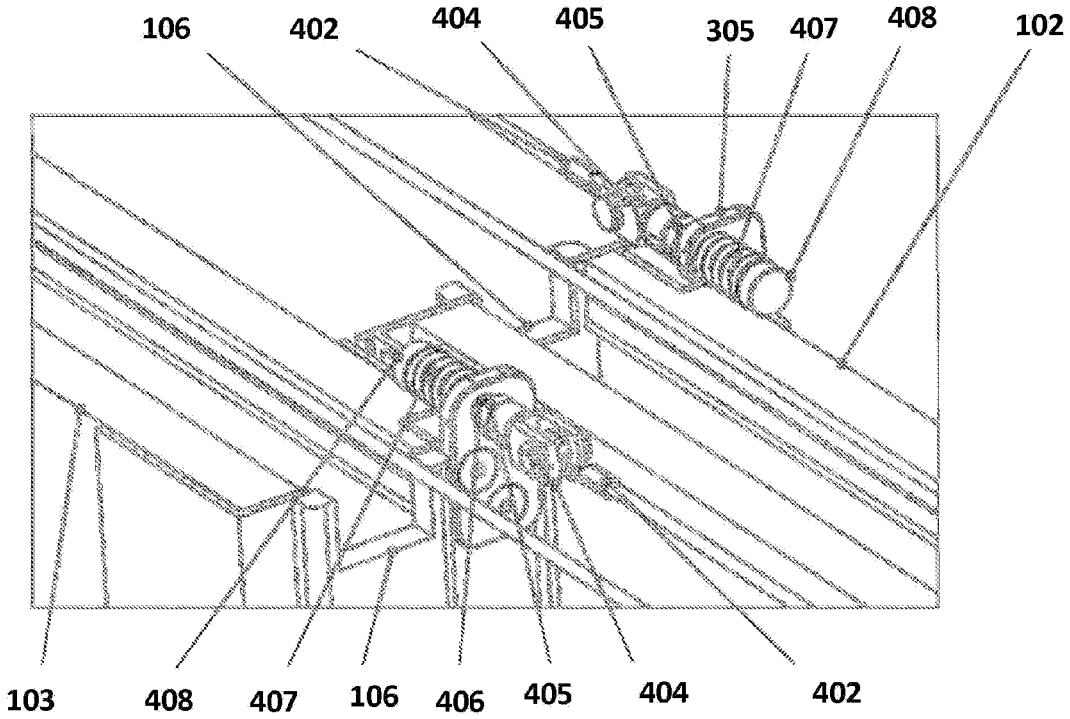
FIG. 13, shows an illustration of an internal and external pane cable coupling to a tension modulator and assembly covering according to an embodiment of the technology.

FIG. 13, shows a bottom isometric view of FIG. 12, removing for clarity opening frame 100. FIG. 13 illustrates distal cable end coupling of cable 402 to pane frame 103, with coupling bracket 301 coupled to coupling bracket backing 303 (not shown), C-clamp 406 can be used to restrict movement of back screw 408. As previously indicated, back screw 408 can be coupled to cable 402 through an orifice defined in coupling bracket 301 attached through pane frame 103 to coupling bracket backing 303 (not shown), with biasing element 407, disposed between coupling bracket 301 and the head of back screw 408, the back screw 408 being coupled (for example by a threading) to socket (e.g. Spelter socket) 404 with optionally a locking bolt 405 limiting the movement of back screw 408 in relation to socket 404. As shown, cable 402 is wrapped around driver pulley 401 (not shown), extending to proximal end as shown in FIG. 2B, wrapping around frame pulley 480 (not shown) and covered by cover 106.

Likewise proximal cable end coupling of cable 402 to pane frame 102, with coupling bracket 303 coupled to pane frame 102. As previously indicated, back screw 408 can be coupled to cable 402 through an orifice defined in coupling bracket 305 attached to pane frame 102, with biasing element 407, disposed between coupling bracket 305 and the head of back screw 408, the back screw 408 being coupled (for example by a threading) to socket (e.g. Spelter socket) 404 with optionally a locking bolt 405 limiting the movement of back screw 408 in relation to socket 404. As shown, cable 402 is wrapped around frame pulley 401 (not shown), extending to distal end, wrapping around frame pulley 480 (not shown) and covered by cover 106.

Figure 14A:
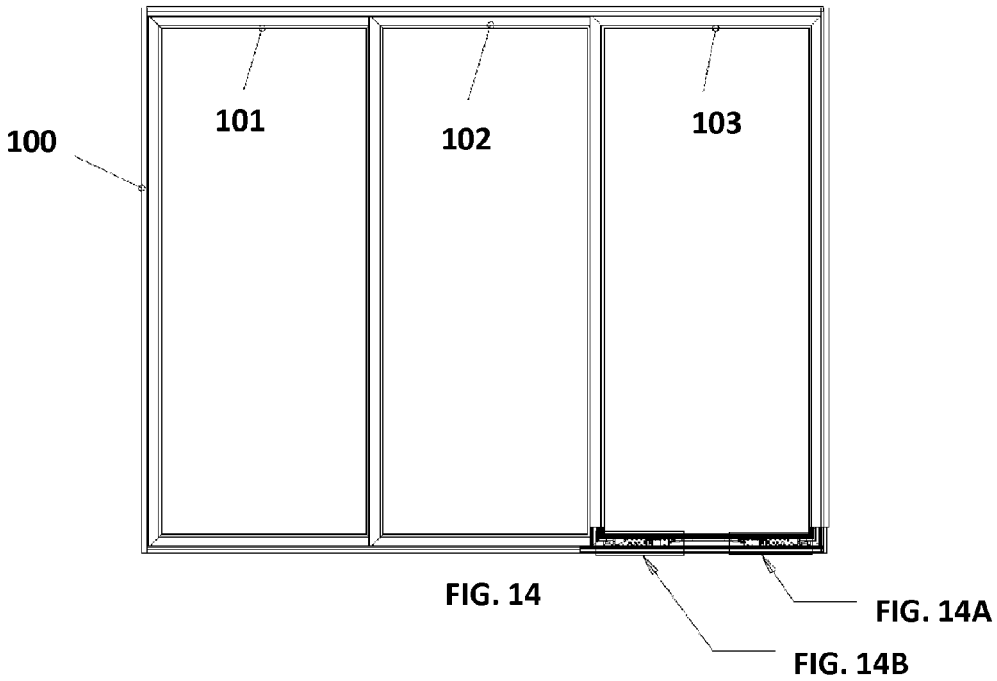
FIG. 14A shows a first drivetrain and FIG. 14B shows a second drivetrain according to an embodiment of the technology.
Figure 14A:
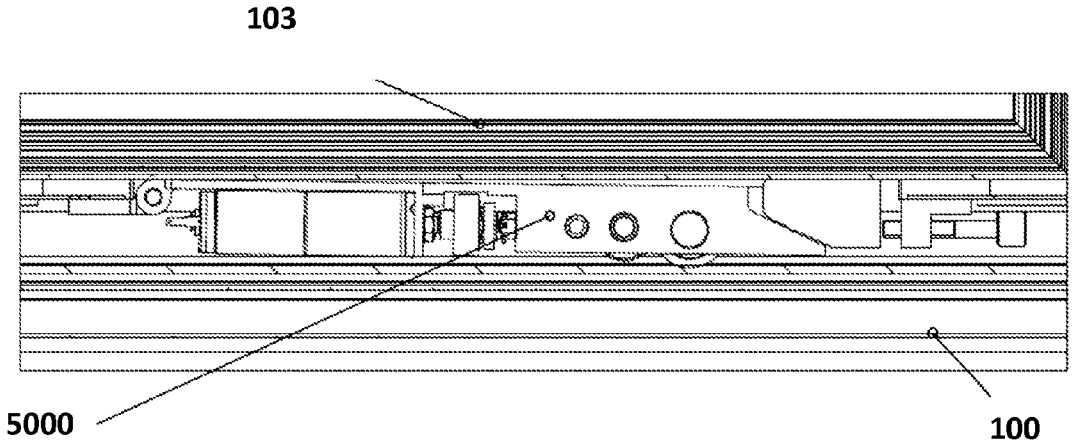
Figure 14B:
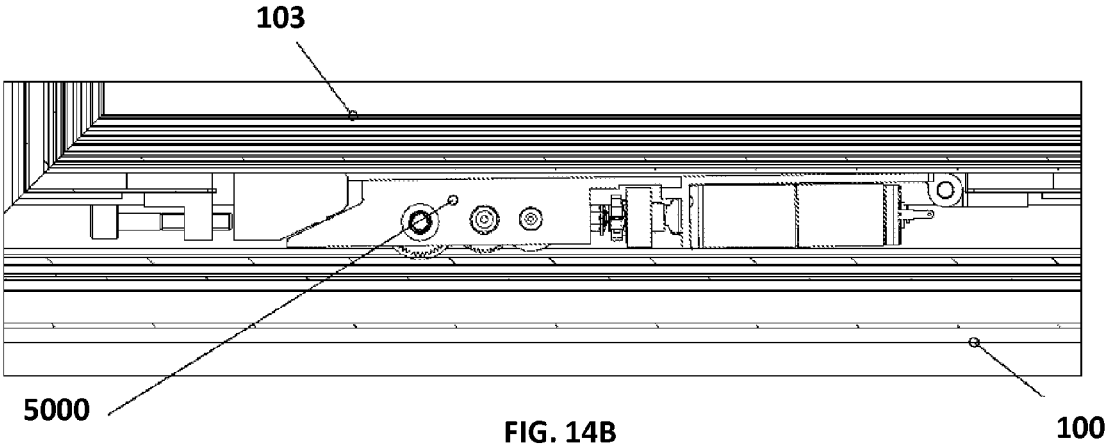

FIG. 14, illustrates an embodiment of the location of drivetrain mechanism described herein, showing side view of opening frame 100 where three panes, internal pane 101, mid pane 102 and external pane 103 are enclosed by pane frame. Cut-away points to corresponding detailed drawings in FIGS. 14 A and 14B. As shown in FIG. 14 A, a first drivetrain assembly 5000 is located within pane frame 103 and rollingly riding on track defined in opening frame (sill) 100 with the drivetrain having a proximal end coupled to the right plane of pane frame 103. FIG. 14B, shows a second drivetrain assembly 5000 located within pane frame 103 and rollingly riding on track defined in opening frame (sill) 100 with the drivetrain having a proximal end coupled to the left plane of pane frame 103.

Turning now to FIGS. 15A and 15B, showing a bottom view of opening frame 100 with a cut away showing drivetrain 5000 detailed in FIG. 15A.

Turning now to FIGS. 16-18, showing various aspects of drivetrain 5000. An isometric view is shown in FIG. 16, where drivetrain 5000 is comprised of a leveling assembly 501 and a mobilizing assembly. Leveling assembly 501 can comprise pad lock screw 502 threaded into pad lock bracket 503 coupled to pad lock base 504, where pad lock screw having a distal end having channels etched thereto in a direction perpendicular to the longitudinal axis of pad lock screw 502 configured to fit within a complimentary groove in height adjustment wedge 505. Pad lock base 504 is configured to couple to closure slab frame or pane frame 103.

Height adjustment wedge 505 having a beveled anterior end can be slidably coupled to (e.g. abut against) mobilizing assembly base 511, having an oppositely slanted posterior end, such that turning pad lock screw 502 will cause the leveling wedge to slide between a bottom surface of closure slab frame or pane frame 103, and the proximal end of mobilizing assembly base 511, lifting or lowering closure slab frame or pane frame 103 in relation to the rail (not shown). Mobilizing assembly base can house a gear box, comprising a first spur gear 509, wherein the spur gear can have involuted teeth either straight or helically cut on its radial surface, which can be configured to engage a second spur gear 513 and wherein the first spur gear is adjacent to a track wheel 460, the track wheel having a radius of between 5 to 25 mm, and extending beyond the surface of assembly base 511. Track wheel 460 having a grooved radial surface configured to engage a rail extending the length of track channel rolling thereon. The first spur gear 509 and the track wheel 460 can be coupled to drivetrain assembly base 511 via a common axle secured to drivetrain assembly base 511 by axle nut 508, while the second spur gear 513 is coupled to drivetrain assembly base 511 via a mid-axle, secured to drivetrain assembly base 511 via mid axle screw. The second spur gear can be configured to engage a third spur gear 517 disposed on a common axle with bevel gear 512, having teeth cut into a conical surface (i.e. a pitch zone). Bevel gear 512, can be meshed together with a conical head attached to drive shaft (not marked) to transmit power between two shafts perpendicular to each other. Beveled driveshaft (not marked) is connected to slip clutch 250 via nut 515. Slip clutch 250 is connected at the opposite end of the beveled driveshaft to a planetary gear box 220 system consisting of one or more outer gears, revolving about a central gear, thereby capable of increasing output speed of the shaft coupled to slip clutch 250. Planetary gearbox 220 can be coupled to drivetrain assembly base 511 via driver connector base 210 with driver motor 203 coupled to planetary gear box 220, and resting against driver flange 510 extending from drivetrain assembly base 511 and terminating in electrical leads 204. Driver flange 510 extending from drivetrain assembly base 511 is coupled to rear axle base 506, hingedly coupled to rear axle screw base 507 via hinge 518, which can be secured with a c-clamp 406. Rear axle screw base 507 is configured to hingedly couple to closure slab frame or pane frame 103, allowing the proximal end of mobilizing assembly base 511 to move freely, vertically lowering and lifting the closure slab frame or pane frame 103 between about 1 and 5 mm. For example, the a first and second drivetrain assemblies comprising the leveling assembly and the mobilizing assembly can be embedded within the lower horizontal pane frame 103, with pad lock screw 502 of the first drivetrain assembly being proximal to left side of pane frame 103 and pad lock screw 502 of the second drivetrain assembly being proximal to the right side of pane frame 103, thus allowing leveling of pane frame 103 through orifices defined in pane frame 103, covered by cover 106 (not shown). Using the CCM, motor revolution can be coordinated.

Figure 19:
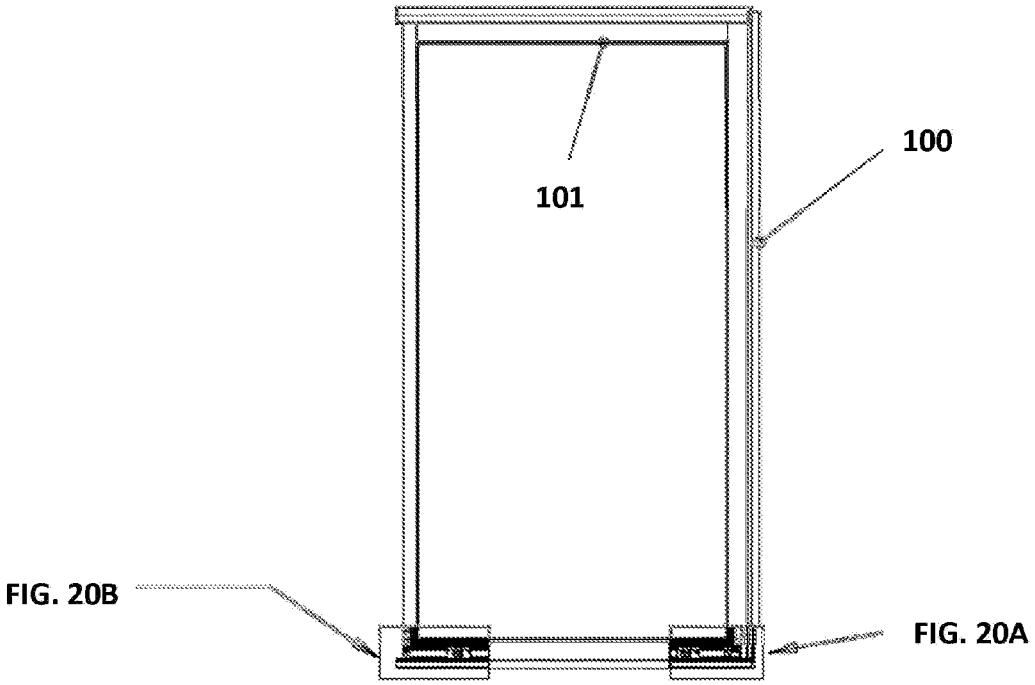
FIG. 19 shows an illustration of motorized driver for a pocket door according to another embodiment of the technology.

Turning now to FIG. 19, showing a side view of an embodiment of a pocket door or a single pane (e.g., pane 101) driven with the drivetrain assemblies described herein. FIG. 19 shows opening frame 100 covering the top bottom and a closed side of an opening, optionally leaving an open side where a pocket configured to receive closure slab 101 is located. Cut-away locations are detailed in FIGS. 20A and 20B.

Figure 20A:
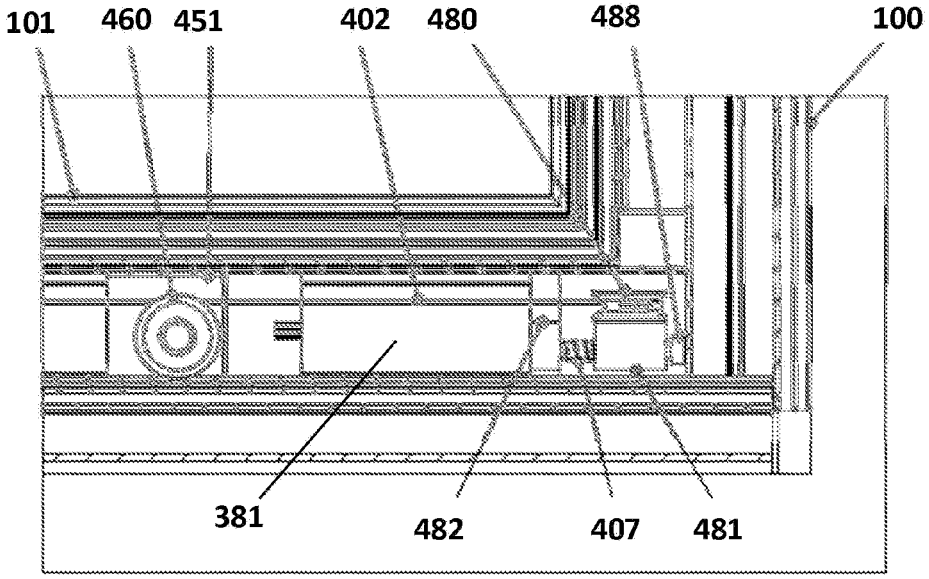

FIGS. 20A and 21A show the side view and bottom view (respectively) of coupling of frame pulley 480 where frame pulley 480 is coupled to frame pulley base 481 with tension modulator assembly comprises parallel tandem tension screws 488 threaded through frame pulley base 481 and into frame pulley base connector 381 with two biasing elements 407 that can be disposed between frame pulley base 481 and frame pulley base connector 381. As shown cable 402 wrap around frame pulley 480 and loops around distal (from the driver) free pulley 450 (hidden by larger diameter track wheel 460). Free distal pulley 450 is coupled between free pulley base 451 and 451' through axle and is disposed such that track wheel 460 can be anterior (in other words, closer to the interior of the building) to free distal pulley 450, wherein free pulley base 451 and 451' are coupled to closure slab frame or pane frame 101.

Figure 21B:
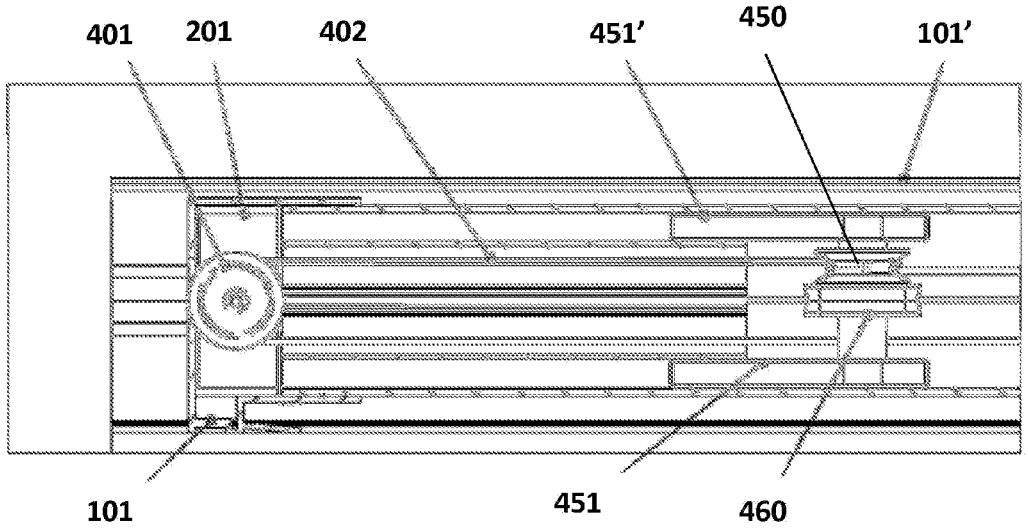

Similarly, FIGS. 20B and 21B show the side view and bottom view (respectively) of coupling of driver pulley 401 to proximal (to the driver) free pulley 450. As shown, driver assembly comprising driver motor 202 and planetary gear box 203 are directly coupled to driver pulley 401 and embedded within the vertical rib of the closure slab frame or pane frame 101. Cable 402 can loop around driver pulley 401 and loops around proximal (i.e. from the driver) free pulley 450 (hidden by larger diameter track wheel 460 in FIG. 20B). Free proximal pulley 450 is coupled between free pulley base 451 and 451' through axle and is disposed such that track wheel 460 can be exterior (in other words, closer to the exterior of the building) to free distal pulley 450, wherein free pulley base 451 and 451' are coupled to closure slab frame 101.

Figure 22:
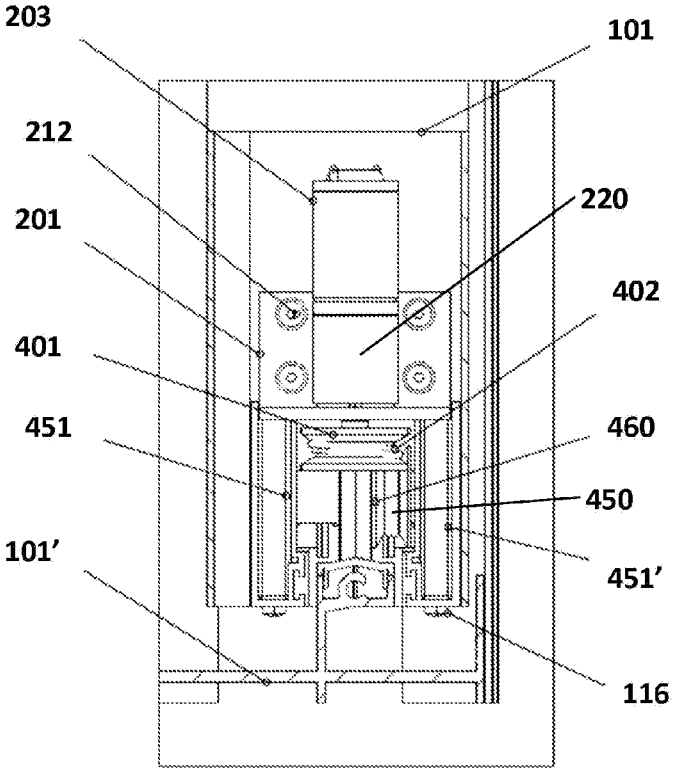
FIGS. 22 and 23 show an illustration of the driver and motor pulley according to an embodiment of the technology.
Figure 23:
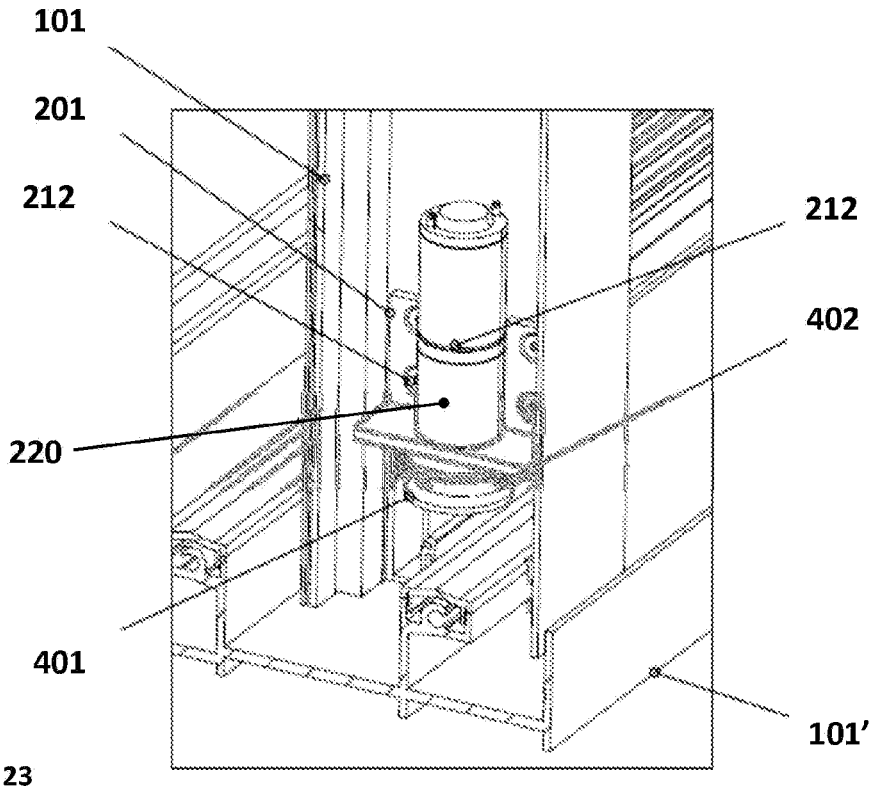

Turning now to FIGS. 22 and 23, showing a rear view (FIG. 22) and an isometric view (FIG. 23) of FIG. 21B, where driver 200 comprises drive motor 203 coupled to planetary gear box 220 coupled to pane frame 101 through driver base 201, and can be secured via screws 212. As shown driver pulley 401 is coupled directly to the drive shaft coupled to planetary gearbox 220. Cable 402 can loop around driver pulley 401 and loops around proximal (i.e. from the driver) free pulley 450 positioned adjacent to the larger diameter track wheel 460. Free proximal pulley 450 is coupled between free pulley base 451 and 451' through axle and is disposed such that track wheel 460 can be exterior (in other words, closer to the exterior of the building) to free distal pulley 450, wherein free pulley base 451 and 451' are coupled to closure slab frame or pane frame 101. Track wheel 460 is configured to rollingly travel along a track defined by opening frame 100 lower profile 101'.

Figure 24:
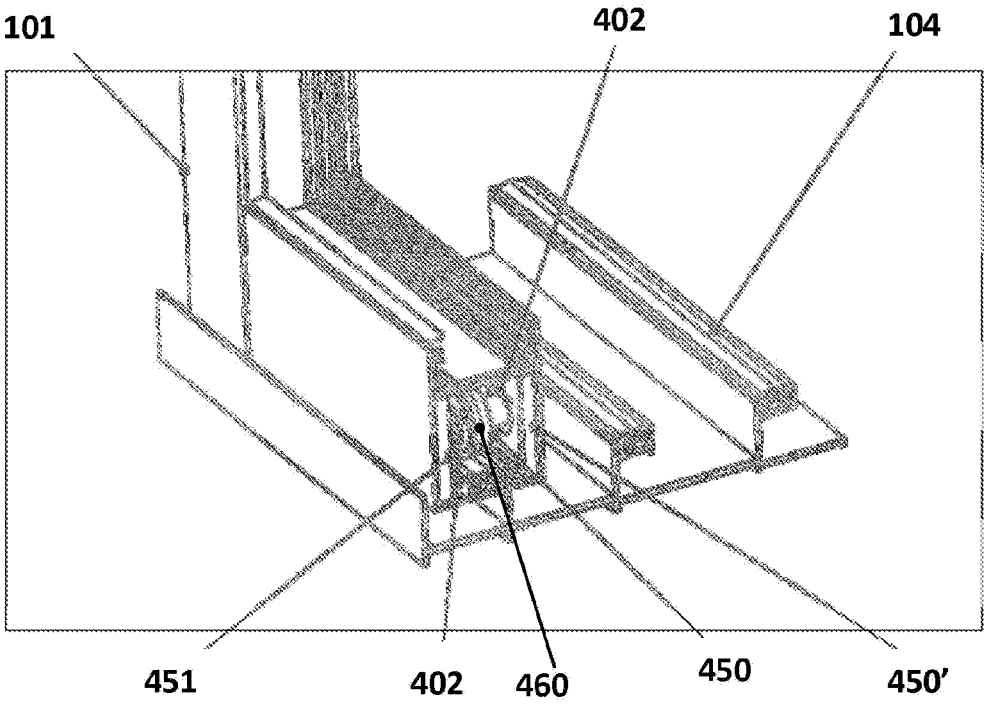
FIG. 24 shows a cut-away illustration of the free pulley according to an embodiment of the technology.

FIG. 24 shows a cross cut of the opening frame (sill) 100 just beyond the location of proximal free pulley 450, showing free proximal pulley 450 positioned adjacent to the larger diameter track wheel 460. Free proximal pulley 450 is coupled between free pulley base 451 and 451' through axle and is disposed such that track wheel 460 can be exterior (in other words, closer to the exterior of the building) to free distal pulley 450, wherein free pulley base 451 and 451' are coupled to closure slab frame 101.

Figure 25:
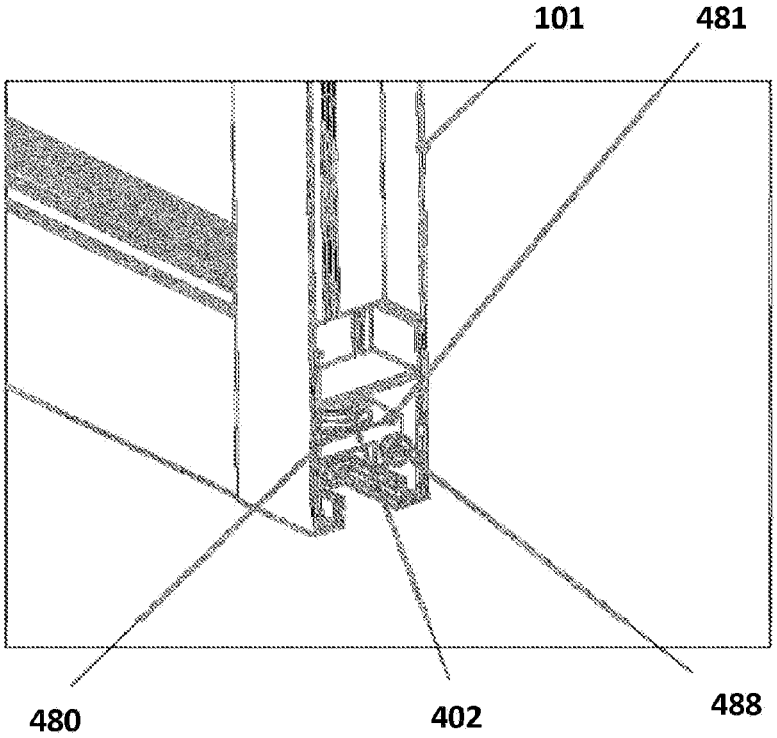
FIG. 25 shows a cut-away illustration of the slab frame pulley according to an embodiment of the technology.

Turning now to FIG. 25, showing an isometric view of the frame pulley 480 configuration, where frame pulley 480 is coupled to frame pulley base 481 (not shown) with tension modulator assembly comprises parallel tension screws 488 threaded through frame pulley base 481 (not shown) and into frame pulley base connector 381 (not shown) with, for example two biasing elements 407 that can be disposed between frame pulley base 481 and frame pulley base connector 381 (not shown). As shown cable 402 wrap around frame pulley 480 and loops around distal (from the driver) free pulley 450 (not shown).

Figure 26:
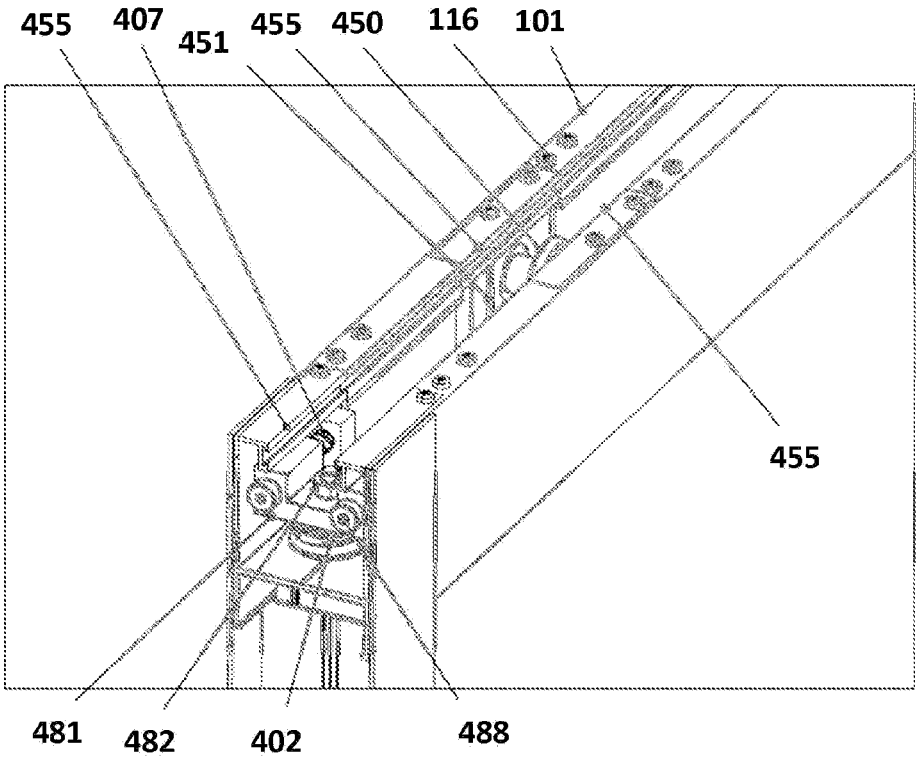
FIG. 26, shows an illustration of the closure frame pulley and the second free pulley connected to the closure frame bracket according to an embodiment of the technology.

Turning now to FIG. 26, showing a bottom isometric view of FIG. 25 illustrating the connection of free distal pulley 450 to closure slab frame 101 via free pulley base 451 and 451' coupling to closure slab frame 101. As shown, frame pulley 480 is coupled to frame pulley base 481 with tension modulator assembly comprises parallel tension screws 488 threaded through frame pulley base 481 and into frame pulley base connector 381 with two biasing elements 407 that can be disposed between frame pulley base 481 and frame pulley base connector 381. As shown cable 402 wrap around frame pulley 480 and loops around distal (from the pocket) free pulley 450 (hidden by larger diameter track wheel 460). Free distal pulley 450 is coupled between free pulley base 451 and 451' through axle and is disposed such that track wheel 460 can be anterior (in other words, closer to the interior of the building) to free distal pulley 450, wherein free pulley base 451 and 451' are coupled to closure slab frame 101 via screws 116 coupling pulley base 451 and 451' to closure slab frame cover 455.

Figure 27:
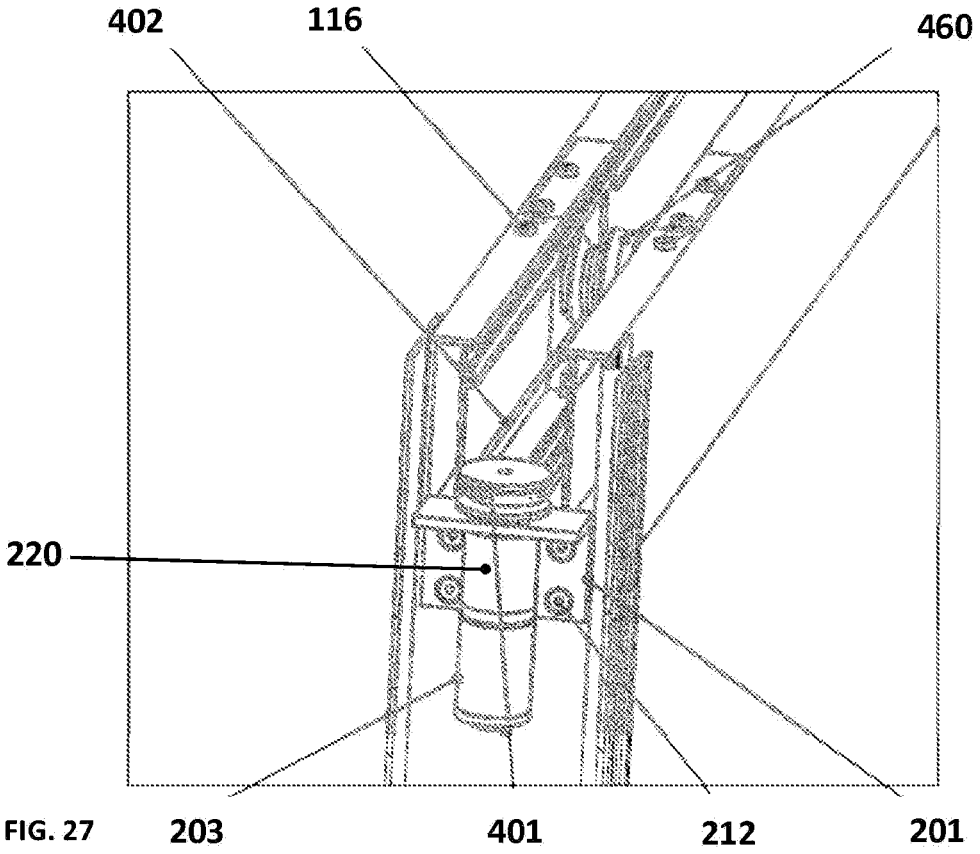
FIG. 27, shows an illustration of the driver and motor pulley and the first free pulley connected to the closure frame bracket according to an embodiment of the technology.

Similarly, FIG. 27, shows a bottom isometric view of FIG. 23, illustrating the connection of free proximal pulley 450 to closure slab frame 101 via free pulley base 451 and 451' coupling to closure slab frame 101. As shown, cable 402 wrap around driver pulley 401 and loops around proximal (i.e. from the pocket) free pulley 450 (hidden by larger diameter track wheel 460 in FIG. 20B). Free proximal pulley 450 is coupled between free pulley base 451 and 451' through axle and is disposed such that track wheel 460 can be exterior (in other words, closer to the exterior of the building) to free distal pulley 450, wherein free pulley base 451 and 451' are coupled to closure slab frame 101 via screws 116 coupling pulley base 451 and 451' to closure slab frame cover 455. Also shown is driver 200 comprising drive motor 203 coupled to planetary gear box 520 (not shown) coupled to pane frame 101 through driver base 201, and can be secured via screws 212. As shown driver pulley 401 is coupled directly to the drive shaft coupled to planetary gearbox 220. Also illustrated, is the orifice defined in closure slab frame or pane frame 101.

Figure 28:
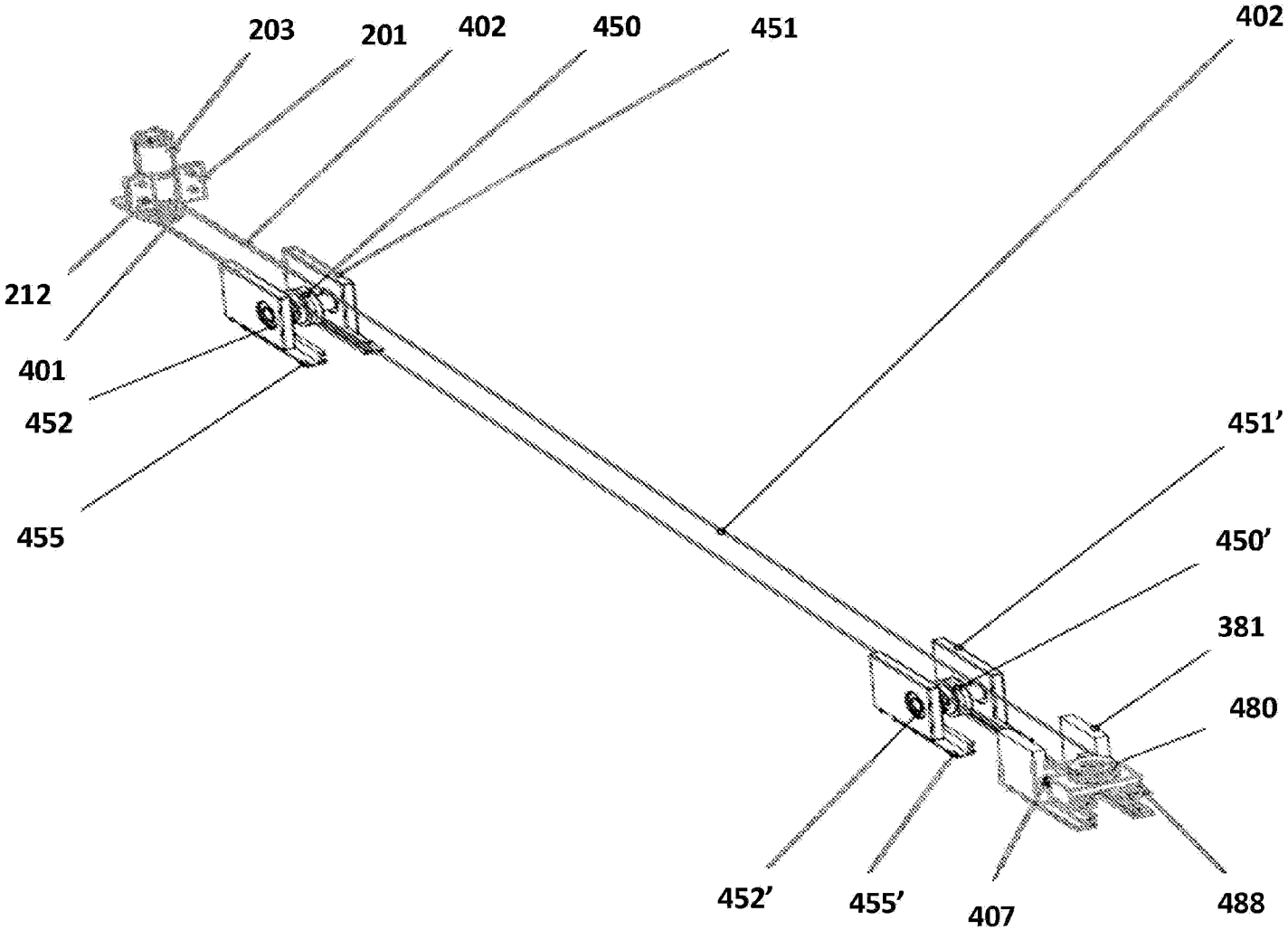
FIG. 28 shows the cable connection between the driver, the first free pulley, the second free pulley and the closure frame pulley according to an embodiment of the technology.

Turning now to FIG. 28, showing a motorized closure mechanism as described herein where, cable 402 loops around driver pulley 401 and loops around proximal (i.e. from the driver) free pulley 450 positioned adjacent to the larger diameter track wheel 460. Free proximal pulley 450 is coupled between free pulley base 451 and 451' through axle and is disposed such that track wheel 460 can be exterior (in other words, closer to the exterior of the building) to free distal pulley 450, wherein cable 402 loops around proximal free pulley 450, extends and wraps around frame pulley 480 coupled to frame pulley base 481 with tension modulator assembly comprises parallel tension screws 488 threaded through frame pulley base 481 and into frame pulley base connector 381 with two biasing elements 407 that can be disposed between frame pulley base 481 and frame pulley base connector 381. As shown cable 402 wrap around frame pulley 480 and loops around distal (from the driver) free pulley 450. Free distal pulley 450 is coupled between free pulley base 451 and 451' through axle and is disposed such that track wheel 460 can be anterior (in other words, closer to the interior of the building) to free distal pulley 450. Accordingly, proximal and distal track wheels 460 can travel on the same rail, while proximal and distal free pulleys 450 are separated by a distance equivalent to the internal diameter of the channel of the frame pulley and the driver pulley. In an example, all the components illustrated in FIG. 28 are embedded within the closure slab frame or pane frame 103 and are in electronic communication with the CCM. Additionally, a clutch can be disposed between planetary gear box 220 and driver pulley 401, allowing closure slab or pane 103 to be moved manually.

In an embodiment, provided herein is a motorized opening assembly, comprising: an opening frame configured to fit around the opening; a substantially rectangular closure slab having a closure slab frame configured to surround the substantially rectangular closure slab and sealingly fit within the opening frame; a driver, the driver concealed in a recess behind the opening frame and coupled to a driver pulley; a frame pulley, concealed in a recess behind the opening frame on a side opposite the driver; and a cable having a proximal end and a distal end, disposed between the frame pulley the driver pulley, and operably coupled to the slab frame wherein the driver, the cable, the motor pulley and the frame pulley are concealed regardless of the position of the closure slab in relation to the opening frame, the assembly capable of slidably moving the slab between an open position and a closed position, wherein (i) the substantially rectangular closure slab comprises: an inner pane; and an outer pane, (ii) wherein each of the inner pane, and outer pane comprise a pane frame, (iii) wherein each of the inner pane, and outer pane comprise: a frame pulley associated therewith, (iv) the opening frame further comprises a driver operably coupled to a marine pulley and a cable associated with each of the inner pane, and outer pane, (v) the cable is operably coupled to the slab frame via a cable tension modulator, wherein (vi) door of a closed structure comprising the assembly described herein, and (vii) a window of a closed structure comprising the assembly disclosed herein.

In another embodiment, provided herein is a drivetrain for a motorized opening assembly, comprising: a leveling assembly; and a mobilizing assembly, wherein the mobilizing assembly comprises: a driver; a clutch; a gear box; and a track wheel coupled to the gear box, the track wheel configured to engage a rail, wherein, (viii) the drivetrain is embedded within a frame of a substantially rectangular closure slab surrounded by the closure slab frame and sealingly fit within an opening frame; (ix) the closure slab train further comprises at least one more drivetrain; (x) the gearbox comprises: a beveled gear; and at least one spur gear, wherein the at least one spur gear is operably coupled to the track wheel, the track wheel configured to engage a rail on the opening frame; (xi) the substantially rectangular closure slab comprises: an inner pane; and an outer pane; (xii) each of the inner pane and outer pane comprise a pane frame; (xiii) the frame each of the inner pane, and outer pane comprises a first dedicated drivetrain and a second dedicated drivetrain disposed on opposite horizontal end of the pane frame; and (xiv) each of the mobilizing assembly of the first drivetrain and the second drivetrain is hingedly coupled to the slab frame. The term "hingedly coupled" means any manner of engagement between a first part relative to a second part which allows the first part to travel relative to the second part without the first part becoming disengaged from the second part and by way of example without limiting the forgoing includes a jointed or flexible device that connects two parts such as the mobilizing assembly and the closure or pane frame allowing rotation between them and by way of non-limiting example includes pivot hinges, continuous hinges, barrel hinges, butt hinges, tee hinges, a flexible sheet material, or the like.

In yet another embodiment, provided herein is a motorized closure assembly, comprising: an opening frame configured to fit around at least the top horizontal side, a distal vertical side, and a bottom horizontal side of a substantially rectangular opening; a substantially rectangular closure slab having a closure slab frame configured to surround the substantially rectangular closure slab and sealingly fit within the opening frame; a driver, the driver embedded within a proximal vertical side of the substantially rectangular closure slab and coupled to a driver pulley; a frame pulley, embedded within and coupled to a distal horizontal side of the substantially rectangular closure slab on a horizontal side opposite the driver pulley; a first free pulley disposed between the driver pulley and the frame pulley and operably coupled to the closure slab frame; and a cable connecting the motor pulley, the first free pulley and the frame pulley, wherein the cable and the free pulley are embedded within the closure slab frame, wherein (xiv) in the open position, the closure slab is recessed within a pocket space in parallel alignment with the slab, configured to receive the closure slab; (xv) further comprising a first bracket operably coupled to the first free pulley, the first free pulley positioned parallel with the closure slab at an anterior side of the bracket and coaxially coupled to a first track wheel; (xvi) further comprising a second bracket operably coupled to a second free pulley, the second free pulley positioned parallel with the closure slab at an exterior side of the bracket, and coaxially coupled to a second track wheel; (xvii) the cable loops around the driver pulley and the first free pulley; (xviii) the cable loops around the driver pulley, the first free pulley, and the second free pulley; and (xix) pocket door comprising the assembly comprising: an opening frame configured to fit around at least the top horizontal side, a distal vertical side, and a bottom horizontal side of a substantially rectangular opening; a substantially rectangular closure slab having a closure slab frame configured to surround the substantially rectangular closure slab and sealingly fit within the opening frame; a driver, the driver embedded within a proximal vertical side of the substantially rectangular closure slab and coupled to a driver pulley; a frame pulley, embedded within and coupled to a distal horizontal side of the substantially rectangular closure slab on a horizontal side opposite the driver pulley; a first free pulley disposed between the driver pulley and the frame pulley and operably coupled to the closure slab frame; and a cable connecting the motor pulley, the first free pulley and the frame pulley, wherein the cable and the free pulley are embedded within the closure slab frame.

Further provided is a motorized closure assembly, comprising: an opening frame configured to fit around the opening; a substantially rectangular closure slab having a closure slab frame configured to surround the substantially rectangular closure slab and sealingly fit within the opening frame; and a motorized driver, wherein the motorized closure assembly is entirely embedded within the closure slab frame or within a combination of the closure slab frame and the opening frame.

While in the foregoing specification the motorized closures has been described in relation to certain preferred embodiments, and many details are set forth for purpose of illustration, it will be apparent to those skilled in the art that the disclosure of the motorized closures is susceptible to additional embodiments and that certain of the details described in this specification and as are more fully delineated in the following claims can be varied considerably without departing from the basic principles of this invention.

We Claim:

1. A drivetrain for a motorized closure assembly, comprising:

a. a leveling assembly, wherein the leveling assembly comprises a height adjustment wedge having a beveled anterior end; and b. a mobilizing assembly, wherein the mobilizing assembly comprises:

i. a driver;

ii. a gear box coupled to the driver;

iii. a track wheel coupled to the gear box, the track wheel engages a rail disposed on an opening frame;

iv. a slanted posterior end, wherein the slanted posterior end is slidably couple to the beveled anterior end of the leveling assembly; and v. optionally, a clutch coupled to the gear box.

2. The drivetrain of claim 1, wherein the drivetrain is embedded within a frame of a substantially rectangular closure slab surrounded by a closure slab frame.

3. The assembly of claim 2, wherein the substantially rectangular closure slab comprises: an inner pane; and an outer pane.

4. The assembly of claim 3, wherein each of the inner pane and outer pane comprise a pane frame.

5. The assembly of claim 4, wherein the pane frame of the inner pane, the pane frame of the outer pane, or both comprises a first dedicated drivetrain and a second dedicated drivetrain disposed on opposite horizontal ends of the pane inner pane frame, the outer pane frame, or both.

6. The drivetrain of claim 2, wherein the leveling assembly further comprises: a pad lock base; a pad lock bracket operably coupled to the pad lock base, and a pad lock screw having a longitudinal axis, operably coupled to the pad lock bracket and to the height adjustment wedge.

7. The drivetrain of claim 6, wherein the pad lock screw comprises a distal end having channels etched thereto in a direction perpendicular to the longitudinal axis of the pad lock screw, configured to fit within a complimentary groove in the height adjustment wedge opposite the anterior beveled end.

8. The drivetrain of claim 7, wherein the pad lock base is operably coupled to the closure slab frame.

9. The drivetrain of claim 2, wherein the mobilizing assembly further comprises:

a. a drivetrain assembly base having a proximal end;

b. a driver connector base coupled to a drivetrain assembly base and the driver;

c. a driver flange extending from the drivetrain assembly base, hingedly coupled to a rear axle base; and d. a rear axle base, wherein the rear axle base is operably coupled to the closure slab frame.

10. The drivetrain of claim 9, wherein the hingedly coupled driver flange is configured to allow the proximal end of the drivetrain assembly base to vertically move the closure slab frame between about 1 and 5 mm.

11. The drivetrain of claim 2, wherein the closure slab frame further comprises a second drivetrain embedded within the frame, the second drive train comprising a leveling assembly and mobilizing assembly.

12. The assembly of claim 11, wherein each of the mobilizing assembly of a first drivetrain and the second drivetrain is hingedly coupled to the slab frame.

13. The drivetrain of claim 1 wherein the gearbox comprises: a beveled gear; and at least one spur gear, wherein the at least one spur gear is operably coupled to the track wheel.

* * * * *